US006458014B1

(12) United States Patent
Ihsikawa et al.

(10) Patent No.: US 6,458,014 B1
(45) Date of Patent: Oct. 1, 2002

(54) POLISHING BODY, POLISHING APPARATUS, POLISHING APPARATUS ADJUSTMENT METHOD, POLISHED FILM THICKNESS OR POLISHING ENDPOINT MEASUREMENT METHOD, AND SEMICONDUCTOR DEVICE MANUFACTURING METHOD

(75) Inventors: Akira Ihsikawa; Tatsuya Senga, both of Kawasaki; Akira Miyaji, Tokyo; Yoshijiro Ushio, Yokohama, all of (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 09/846,339

(22) Filed: May 2, 2001

Related U.S. Application Data

(63) Continuation of application No. PCT/JP00/01545, filed on Mar. 14, 2000.

(30) Foreign Application Priority Data

| | | |
|---|---|---|
| Mar. 31, 1999 | (JP) | 11-91077 |
| Dec. 3, 1999 | (JP) | 11-345058 |
| Jan. 20, 2000 | (JP) | 2000-11126 |
| Feb. 2, 2000 | (JP) | 2000-25223 |

(51) Int. Cl.[7] ..... B24B 49/00; B24B 51/00

(52) U.S. Cl. ..... 451/6; 451/41; 451/287; 451/526

(58) Field of Search ..... 451/5, 6, 7, 9, 451/41, 285–288, 490, 526

(56) References Cited

U.S. PATENT DOCUMENTS

| | | | | |
|---|---|---|---|---|
| 5,433,651 A | * | 7/1995 | Lustig et al. | 451/6 |
| 5,605,760 A | * | 2/1997 | Roberts | 428/409 |
| 5,609,511 A | | 3/1997 | Moriyama et al. | 451/5 |
| 5,893,796 A | * | 4/1999 | Birang et al. | 451/526 |
| 5,964,643 A | * | 10/1999 | Birang et al. | 451/6 |
| 6,045,439 A | * | 4/2000 | Birang et al. | 451/526 |
| 6,068,539 A | * | 5/2000 | Bajaj et al. | 451/6 |
| 6,074,287 A | * | 6/2000 | Miyaji et al. | 451/287 |
| 6,106,662 A | * | 8/2000 | Bibby, Jr. et al. | 156/345 |
| 6,108,091 A | * | 8/2000 | Pecen et al. | 356/381 |
| 6,146,242 A | * | 11/2000 | Treur et al. | 451/6 |
| 6,146,248 A | * | 11/2000 | Jairath et al. | 451/41 |
| 6,213,845 B1 | * | 4/2001 | Elledge | 451/6 |
| 6,254,459 B1 | * | 7/2001 | Bajaj et al. | 451/41 |
| 6,261,155 B1 | * | 7/2001 | Jairath et al. | 451/41 |
| 6,273,792 B1 | * | 8/2001 | Meloni | 451/41 |
| 6,280,290 B1 | * | 8/2001 | Birang et al. | 451/6 |
| 6,309,276 B1 | * | 10/2001 | Tsai et al. | 451/5 |

FOREIGN PATENT DOCUMENTS

| | | |
|---|---|---|
| EP | 0 738 561 | 10/1996 |
| JP | 7-52032 | 2/1995 |
| JP | 10-125634 | 5/1998 |

* cited by examiner

*Primary Examiner*—M. Rachuba
*Assistant Examiner*—David B. Thomas
(74) *Attorney, Agent, or Firm*—Morgan, Lewis, Bockius LLP

(57) ABSTRACT

After a hole is formed in a polishing pad, a transparent window plate is inserted into the hole. Here, a gap is left between the upper surface of the transparent window plate and the outermost surface constituting the working surface of the polishing pad. During polishing, the polishing head holding the wafer applies a load to the polishing pad by means of a load-applying mechanism, so that the polishing pad and transparent window plate are compressed. In this case, the system is arranged so that the gap remains constant, and so that a dimension equal to or greater than a standard value is maintained. Since the upper surface of the transparent window plate is recessed from the upper surface of the polishing pad, there is no scratching of the surface of the transparent window plate during dressing. Accordingly, the polishing pad has a long useful life.

31 Claims, 17 Drawing Sheets

Section along line A-O

Section along line B-O

Section along line C-O

Section along line D-E

Section along line F-G

FIG. 15A
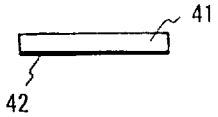
FIG. 15B
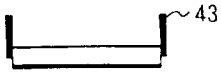
FIG. 15C
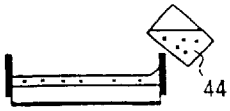
FIG. 15D
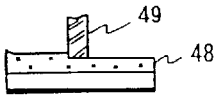
FIG. 15E
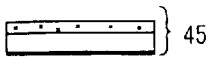
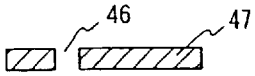
FIG. 15F
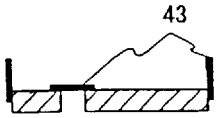
FIG. 15G
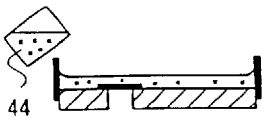
FIG. 15H
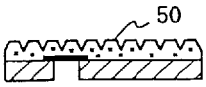
FIG. 15I
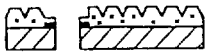
FIG. 15J
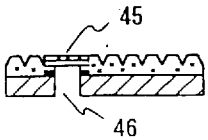
FIG. 15K

POLISHING BODY, POLISHING APPARATUS, POLISHING APPARATUS ADJUSTMENT METHOD, POLISHED FILM THICKNESS OR POLISHING ENDPOINT MEASUREMENT METHOD, AND SEMICONDUCTOR DEVICE MANUFACTURING METHOD

This application is a continuation under 35 U.S.C. §120 of PCT International Application No. PCT/JP00/01545, with an international filing date of Mar. 14, 2000, which claims the benefit of Japanese Patent Application Nos.: 11-345058, filed Dec. 3, 1999; 2000-11126, filed Jan. 20, 2000; and, 2000-25323, filed Feb. 2, 2000.

BACKGROUND OF THE INVENTION

1. Field of the Invention

The present invention relates to a polishing body, polishing apparatus, polishing apparatus adjustment method and polished film thickness or polishing endpoint measurement method which are suitable for use in the polishing of semiconductor devices in a method for manufacturing semiconductor devices such as ULSI devices, etc., and to a semiconductor device manufacturing method.

2. Discussion of the Related Art

As semiconductor integrated circuits have become finer and more highly integrated, the individual processes involved in semiconductor manufacturing processes have become more numerous and complicated. However, the surfaces of semiconductor devices are not always flat. The presence of step differences on the surfaces of semiconductor devices leads to step breakage of wiring and local increases in resistance, etc., and thus causes wiring interruptions and drops in electrical capacitance. Furthermore, in insulating films such step differences also lead to a deterioration in the withstand voltage and the occurrence of leaks.

Meanwhile, as semiconductor integrated circuits have become finer and more highly integrated, the wavelengths of light sources in semiconductor exposure apparatuses used in photolithography have become shorter, and the numerical aperture or so-called NA of the projection lenses used in such semiconductor exposure apparatuses has become larger. As a result, the focal depth of the projection lenses used in such semiconductor exposure apparatuses has become substantially shallower. In order to deal with such increasing shallowness of the focal depth, there is a demand for even greater planarization of the surfaces of semiconductor devices than that achieved so far.

Specifically, planarization techniques such as that shown in FIG. 1 have become essential in semiconductor manufacturing processes. A semiconductor device 14, and inter-layer insulating film 12 comprising $SiO_2$ and a metal film 13 comprising Al are formed on the surface of a silicon wafer 11. FIG. 1(*a*) shows an example of the planarization of an inter-layer insulating film 12 on the surface of the semiconductor device. FIG. 1(*b*) shows an example in which a so-called damascene is formed by polishing a metal film 13 on the surface of the semiconductor device.

A chemical mechanical polishing or chemical mechanical planarization (hereafter referred to as "CMP") technique is widely used as a method for planarizing the surfaces of such semiconductor devices. Currently, the CMP technique is the sole method that can be used to planarize the entire surface of a silicon wafer.

CMP was developed on the basis of silicon wafer mirror surface polishing methods. FIG. 2 is a schematic structural diagram of a polishing (planarization) apparatus used in CMP. This polishing apparatus is constructed from a polishing member 15, an object of polishing holding part (hereafter referred to as a "polishing head" in some instances) 16, and a polishing agent supply part 18. Furthermore, a silicon wafer 17 which is the object of polishing is attached to the polishing head 16, and the polishing agent supply part 18 supplies a polishing agent (slurry) 19. The polishing member 15 is formed by attaching a polishing body (hereafter referred to as a "polishing pad" in some instances) 21 to the surface of a platen 20.

The silicon wafer 17 is held by the polishing head 16, so that they are caused to oscillate while being rotated, and is pressed against the polishing body 21 of the polishing member 15 with a specified pressure. The polishing member 15 is also rotated, so that a relative motion is performed between the polishing member 15 and the silicon wafer 17. In this state, the polishing agent 19 is supplied to the surface of the polishing body 21 from the polishing agent supply part 18. The polishing agent 19 diffuses over the surface of the polishing body 21, and enters the space between the polishing body 21 and the silicon wafer 17 as the polishing member 15 and silicon wafer 17 move relative to each other, so that the polishing surface of the silicon wafer 17 is polished. Specifically, good polishing is accomplished by a synergistic effect of the mechanical polishing caused by the relative motion of the polishing member 15 and silicon wafer 17 and the chemical action of the polishing agent 19.

The relationship between the amount of polishing of a silicon wafer and the above-mentioned polishing conditions is given by an empirical formula known as the formula of Preston, which is indicated by Equation (1).

$$R=K\times P\times V \tag{1}$$

Here, R is the amount of polishing of the silicon wafer, P is the pressure per unit area with which the silicon wafer is pressed against the polishing body, V is the relative linear velocity caused by the relative motion between the polishing member and the silicon wafer, and k is a proportionality constant.

Conventionally, the endpoint of CMP polishing has been determined by time control using the formula of Preston on the basis of the polishing rate calculated by means of film thickness measurement using an ellipsometer, etc., after polishing several tens of dummy samples and performing a cleaning process. In CMP, however, variation occurs in the polishing rate because of the temperature distribution of the polishing body and local differences in the polishing agent supply conditions. Furthermore, because of variations in the surface conditions of the polishing body, the polishing rate drops with the number of wafers processed, and there are differences in the polishing rate due to individual differences between polishing bodies, etc. Accordingly, it is difficult to determine the endpoint of polishing by performing a specified amount of polishing using time control.

Furthermore, the time control method requires polishing work using as many as several tens of dummy samples in order to determine the polishing rate. Accordingly, this polishing work results in increased costs, and is therefore undesirable for stabilizing the semiconductor device manufacturing process and reducing production costs.

Accordingly, methods in which the endpoint of polishing is determined while measuring the motor torque or vibration, etc., in situ have been proposed as a substitute for endpoint determination by time control. Such methods are effective in the case of CMP wherein the material of the object of polishing varies (e.g., CMP of wiring materials or CMP in which there are stopper layers). However, in the case of silicon wafers having complicated patterns, there is little variation in the material of the object of polishing. Accordingly, there are cases in which it is difficult to ascertain the endpoint. Furthermore, in the case of CMP of inter-layer insulating films, it is necessary to control the inter-wiring capacitance. Accordingly, control of the residual film thickness is required rather than control of the polishing endpoint. It is difficult to measure the film thickness using a method in which the endpoint is ascertained by in-situ measurement of the motor torque or vibration, etc.

Recently, optical measurements, especially in-situ endpoint detection and in-situ film thickness measurement based on the measurement of spectroscopic reflections, have come to be viewed as effective means of solving the above-mentioned problems. For instance, one example of such measurement is described in U.S. Pat. No. 5,433,651. For such in-situ measurements, a common method is a method in which an opening part 22 used for measurement is formed in the platen 20 and polishing body 21 a shown in FIG. 2, and the surface of the object of polishing is observed by means of a polished-state measuring device 23 that measures the polished state via this opening part 22. Although not shown in FIG. 2, a transparent window is generally installed in the polishing body 21, etc., in order to close off the opening part. By installing such a window, it is possible to allow the measurement light from the polished-state measuring device 23 to pass through the window, while preventing the polishing agent 19 from leaking into the polished-state measuring device 23 via the opening part 22. In cases where no window is installed, the slurry, water and other components used in cleaning, etc., leak from this area. As a result, a complicated mechanism is required, so that the apparatus becomes complicated.

A so-called foam polishing pad comprising a foam polyurethane has been used in the past as the polishing body 21. However, in the case of foam polyurethane polishing pads, the polishing agent causes clogging, so that the polishing characteristics are unstable. Accordingly, in the case of foam polyurethane polishing pads, dressing of the polishing pad surface is generally performed using of a diamond grinding wheel in order to perform stable polishing. Dressing is a treatment which removes the polishing agent that has clogged the surface of the polishing pad, and which at the same time cuts away the surface of the foam polyurethane polishing pad, so that a fresh polishing pad surface is created. Recently, non-foam polishing bodies that do not require dressing have also begun to be used.

In cases where a window used for measurement is formed in the polishing pad for the purpose of performing the above-mentioned optical measurements, because the polishing body is generally not transparent, it is necessary to install a transparent material that differs from the material of the polishing body in the area where the window is formed. Since this material generally differs from the material of the polishing body in terms of mechanical properties, there is a serious danger that this material will cause differences in the polishing rate, polishing non-uniformities, and scratching. Furthermore, problems also arise from the window becoming scratched so that it becomes optically opaque when the polishing body (polishing pad) is cut away during the above-mentioned dressing. As a result, measurements become impossible.

Furthermore, since the polishing agent is discharged onto the polishing body during polishing, observation must be performed through the polishing agent as well. Since the polishing agent, which is dispersive, causes attenuation of the measurement light, the amount of polishing agent interposed in the measurement light path should be small when high-precision measurements are being performed. Specifically, if there is a step difference between the surface of the polishing body and the surface of the window on the side of the object of polishing, the polishing agent will accumulate in the opening part, thereby causing attenuation of the measurement light. Accordingly, it is better if there is no such step difference.

Furthermore, to reduce the intensity loss of the light that is used to measure the polished state, it is desirable to form an anti-reflection film on the opposite surface of the window from the side of the silicon wafer. However, in cases where an anti-reflection film is formed on a window that is manufactured from a soft material, cracks are formed in the anti-reflection film as a result of the bending of the window. Furthermore, since the glass transition temperature of the window is low, the window may expand or contract as a result of temperature changes, so that cracks are formed in the anti-reflection film. Accordingly, in cases where the window is manufactured from a soft material, formation of an anti-reflection film is difficult.

Furthermore, in cases where a soft transparent material that does not cause scratching of the silicon wafer, e.g., a polyurethane, nylon or soft acrylic resin, etc., is disposed in the opening part, the pressure that is applied to the window fluctuates when the opening part moves beneath the silicon wafer as a result of the rotation of the platen. Accordingly, the window that is installed undergoes deformation, thus causing optical distortion. As a result of this distortion, the window acts as a lens, etc., so that that detection of the polishing endpoint and measurement of the film thickness become unstable.

Furthermore, the problem of erroneous measurement arises in cases where the polished film thickness or polishing endpoint is measured without a constant thickness of the polishing agent between the window and the object of polishing.

SUMMARY OF THE INVENTION

The first aspect of the present invention is to solve the above-mentioned problems, and to provide a polishing body which is used in a polishing apparatus that is capable of measuring the polished state by means of light, namely a polishing body that does not cause instability in polishing, a polishing body which has a measurement window that does not require a complicated mechanism, a polishing body that does not suffer from problems such as scratching during dressing, etc., and a polishing body that does not cause instability in the detection of the polishing endpoint in situ, and a polishing apparatus which uses such polishing bodies.

Furthermore, the first aspect of the present invention also includes the provision of a polishing apparatus which is capable of measuring the polished state by means of light, and in which there is no scratching of the polishing body or instability in measurement, and a polishing apparatus adjustment method and polishing endpoint determination method in which there is no erroneous measurement in the measurement of the polished film thickness or polishing endpoint.

The second aspect of the present invention is to provide a semiconductor device manufacturing method in which the process is made more efficient by reducing the cost of the polishing process and detecting the polished state with good precision as a result of the use of the polishing apparatus, polishing apparatus adjustment method and polishing endpoint determination method, and which therefore makes it possible to manufacture semiconductor devices at a lower cost than conventional semiconductor device manufacturing methods.

A first embodiment of the present invention which is used in order to achieve the first aspect is a polishing body used in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing; the polishing body comprising one or more opening parts which are used to allow the passage of measurement light that optically measures the surface that is being polished on the object of polishing are formed in the polishing body, window plates that are transparent to at least the measurement light are fit into the opening parts, and the gap between the outermost surface of the polishing body (i.e., the surface that contacts the object of polishing) and the surfaces of the window plates on the side of the outermost surface in an unloaded state is adjusted so that this gap is greater than the amount of compressive deformation of the polishing body that occurs when the polishing load is applied.

In the present invention, the gap between the outermost surface of the polishing body and the surfaces of the window plates on the side of the outermost surface (hereafter referred to as the "upper surfaces" of the window plates in some instances) in an unloaded state is adjusted so that this gap is greater than the amount of compressive deformation of the polishing body that occurs when the polishing load is applied. Accordingly, even if the polishing body should contract as a result of compressive deformation when the polishing load is applied, the outermost surface of the polishing body will be closer to the object of polishing than the outermost surfaces of the window plates. Accordingly, even when the polishing load is applied, the window plates will not contact the object of polishing; consequently, scratching of the window plates can be prevented.

A second embodiment of the present invention which is used in order to achieve the first aspect is a polishing body used in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing; this polishing body being characterized by the fact that one or more opening parts which are used to allow the passage of measurement light that optically measures the surface that is being polished on the object of polishing are formed in the polishing body, window plates that are transparent to at least the measurement light are fit into the opening parts, and the window plates are constructed by laminating two or more plates comprising transparent materials.

In the present invention, the window plates disposed in the opening parts are formed by laminates of two or more plates comprising transparent materials. Accordingly, in one window, the compressive elastic modulus (hardness) of the surface located on the side of the object of polishing and the compressive elastic modulus (hardness) of the surface located on the opposite side from the object of polishing can be caused to differ by varying the compressive elastic modulus (hardness) of the transparent material located on the side of the object of polishing and the compressive elastic modulus (hardness) of the other transparent material (s). Accordingly, the compressive elastic modulus (hardness values) of the respective window materials can be set at ideal values, so that the compressive elastic modulus (hardness) of each window as a whole can also be set at an ideal value. Furthermore, the present invention can also be applied to the first embodiment of the invention.

A third embodiment of the present invention which is used in order to achieve the first aspect is the invention of the second embodiment, which is further characterized by the fact that the window plates each comprising two plates of transparent materials that are laminated together, and by the fact that among these plates of transparent materials, the compressive elastic modulus of the transparent material plate that is located on the side of the object of polishing is set at a smaller value than the compressive elastic modulus of the transparent material plate that is located on the opposite side from the object of polishing.

As a result, the transparent material plate located on the opposite side from the object of polishing comprising a material that has a large compressive elastic modulus (i.e., a hard material). Accordingly, deformation of the windows is eliminated, so that there is no instability in the detection of the polishing endpoint or instability in the measurement of the film thickness due to deformation of the windows.

A fourth embodiment of the present invention which is used in order to achieve the first aspect of the invention is the second and third embodiments, which is further characterized by the fact that the compressive elastic modulus e of the transparent material on the side of the object of polishing (among the transparent materials) is such that $2.9\times10^{7}\text{Pa}\leqq e\leqq1.47\times10^{9}$ Pa, and is more or less the same as the compressive elastic modulus of the polishing body.

As a result, since the compressive elastic modulus of the transparent material on the side of the object of polishing has more or less the same value as the compressive elastic modulus of the polishing body, scratching of the object of polishing as a result of the window material protruding from the surface of the polishing body and contacting the object of polishing when deformation of the window material is caused by the load applied during polishing is eliminated. Furthermore, non-uniform polishing is also eliminated.

A fifth embodiment of the present invention which is used in order to achieve the first aspect is a polishing body used in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing; the polishing body comprising one or more opening parts which are used to allow the passage of measurement light that optically measures the surface that is being polished on the object of polishing are formed in the polishing body, window plates that are transparent to at least the measurement light are fit into the opening parts, and the surfaces of the window plates on the side of the object of polishing are recessed with respect to the surface of the polishing body, with the amount of this recess being varied in a stepwise or continuous manner.

In such a polishing body, the amount of recess of the window plates with respect to the surface of the polishing body varies; accordingly, even if scratches are formed in the surfaces of the window plates by dressing or polishing due to deformation of the polishing body, etc., the extent of the scratches is limited to a certain area. Accordingly, in cases where such scratching occurs, in-situ measurement of the polished state can be accomplished by selecting an area that is free of scratches, and using this area to observe the polished surface of the object of polishing, so that the frequency of replacement of the polishing body or window plates can be reduced. As a result, the cost of polishing can be reduced.

Furthermore, since the polishing agent enters the areas between the portions corresponding to the surface parts of the polishing body in the opening parts and the surface parts of the window plates, so that the measurement light is absorbed by a corresponding amount, it is desirable that the amount of recess be as small as possible. However, if this amount of recess is set at a shallow value, the windows tend to be scratched for the reasons described above. The present invention solves this trade-off. Specifically, this trade-off is solved by performing in-situ measurements using opening parts in which the amount of recess is as small as possible, and using unscratched portions in areas where the amount of recess is deep in cases where the windows become scratched.

A sixth embodiment of the present invention which is used in order to solve the first aspect of the present invention is the fifth embodiment, which is further characterized by the fact that the polishing body has a plurality of the opening parts, and the amount of recess varies in a stepwise manner as a result of this amount of recess being different in each of the opening parts.

As a result, when the polished state of the object of polishing is observed by means of the device that measures the polished state, even if the windows in the opening parts in which the amount of recess is small are scratched as a result of dressing or polishing, there is no scratching of the windows in the opening parts in which the amount of recess is large. Accordingly, for the reasons described above, in-situ measurement of the polished state can be accomplished by first using opening parts in which the amount of recess is small for measurement, and then, in cases where these windows become scratched, switching the observation of the polished state of the object of polishing by means of the device that measures the polished state to windows in opening parts in which the amount of recess in the initial state is different, so that the windows are unscratched.

A seventh embodiment of the present invention which is used in order to achieve the first aspect of the present invention is the fifth embodiment, which is further characterized by the fact that the amount of recess varies in a stepwise manner as a result of this amount of recess being different in two or more portions within the same opening part.

As a result, in cases where a portion of a window plate being used for measurement (in most cases, a portion in which the amount of recess is small) becomes scratched during the observation of the polished state of the object of polishing by means of the device that measures the polished state, in-situ measurement of the polished state can be accomplished by switching the observation of the polished state of the object of polishing by means of the device that measures the polished state to a portion of the window plate in which the amount of recess in the initial state is different, so that this portion of the window plate is unscratched.

An eighth embodiment of the present invention which is used in order to achieve the first aspect of the present invention is the fifth embodiment, which is further characterized by the fact that the window plates are parallel flat-plate-form transparent plates, and the window plates are installed at an inclination with respect to the surface of the above-mentioned polishing body, so that the amount of recess varies in a continuous manner.

As a result, in cases where a portion of a window plate being used for measurement (in most cases, a portion in which the amount of recess is small) becomes scratched during the observation of the polished state of the object of polishing by means of the device that measures the polished state, in-situ measurement of the polished state can be accomplished by switching the observation of the polished state of the object of polishing by means of the device that measures the polished state to a portion of the window plate in which the amount of recess in the initial state is different, so that this portion of the window plate is unscratched.

A ninth embodiment of the present invention which is used in order to achieve the first aspect is a polishing body used in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing; the polishing body comprises one or more opening parts which are used to allow the passage of measurement light that optically measures the surface that is being polished on the object of polishing are formed in the polishing body, window plates that are transparent to at least the measurement light are fit into the opening parts, the surfaces of the window plates on the side of the object of polishing are recessed with respect to the surface of the polishing body, and the window plates are constructed from a plate material comprising a plurality of sheets of a transparent material that can be stripped away.

In the present means, in cases where the surface of a window plate that is being used for measurement becomes scratched when the polished state of the object of polishing is observed by means of the device that measures the polished state, in-situ measurement of the polished state can be accomplished by stripping away the scratched plate material, so that the underlying plate material is exposed at the surface of the window plate.

A tenth embodiment of the present invention which is used in order to achieve the first aspect of the present invention is any of the first through ninth embodiments, which is further characterized by the fact that the minimum value G of the gap between the outermost surface of the polishing body and the surfaces of the window plates on the side of the outermost surface is such that $0\ \mu m < G \leqq 400\ \mu m$.

In cases where an ordinary polishing agent is considered, if the gap G (amount of recess) between the outermost surface of the polishing body and the surfaces of the window plates on the side of the outermost surface exceeds 400 $\mu$m, the measurement light is absorbed by the polishing agent that enters this gap (hole), so that it becomes difficult to measure the state of the polished surface of the object of polishing. Accordingly, it is desirable that this gap be 400 $\mu$m or less in positions where the measurement light passes through. In cases where this gap (depth) differs according to location within a single opening part or between different opening parts, measurements can be performed using portions where the gap is within this range, as along as the minimum value G of the gap between the outermost surface of the polishing body and the surfaces of the window plates on the side of this outermost surface is set so that this minimum value is within the range. Furthermore, since the amount of recess is at least greater than zero, contact between the window plates and the object of polishing is eliminated.

An eleventh embodiment of the present invention which is used in order to achieve the first aspect of the present invention is any of the first through ninth embodiments, which is further characterized by the fact that the minimum value G of the gap between the outermost surface of the polishing body and the surfaces of the window plates on the side of the outermost surface is such that $10\ \mu m < G \leqq 200\ \mu m$.

As was described above, it is desirable that the minimum value G of the gap between the outermost surface of the polishing body and the surfaces of the window plates on the side of this outermost surface be 400 $\mu$m or less. In the present invention, however, this gap G is limited to 200 $\mu$m or less as an even more desirable range. Furthermore, this gap G is limited to 10 $\mu$m or greater as a desirable range that tends to prevent the window plates from flying off of the surface of the polishing body.

A twelfth embodiment of the present invention which is used in order to solve the above mentioned problems is any of the first through ninth embodiments, which is further characterized by the fact that the gap G between the outermost surface of the polishing body and the surfaces of the window plates on the side of the outermost surface (the maximum value of G in cases where the gap G differs within a single opening part or between different opening parts) is such that $0\ \mu m < G \leqq$(90% of the thickness of the polishing body), and the thickness t of the window plates (the minimum value of the thickness t in cases where this thickness t differs within a single opening part or between different opening parts) is such that $t \geqq$(10% of the thickness of the polishing body).

As a result, contact between the windows and the object of polishing is eliminated, so that there is no scratching of the object of polishing or scratching of the windows. Furthermore, since the depth of the recessed parts is not too deep, the attenuation of the measurement light caused by slurry entering the recessed parts so that stable measurement becomes impossible can be prevented. Moreover, since the thickness of the windows is not too thin, deformation of the windows can be eliminated, so that there is no instability in the detection of the polishing endpoint or instability in the measurement of the film thickness due to deformation of the windows.

A thirteenth embodiment of the present invention which is used in order to solve the above-mentioned problems is any of the first through twelfth embodiments, which is further characterized by the fact that at least the surfaces of the window plates located on the side of the object of polishing are coated with a hard coating.

In spite of the fact that the gap between the outermost surface of the polishing body and the surfaces of the window plates on the side the outermost surface is set with the load during polishing being taken into account so that the window plates do not contact the wafer or the retainer ring of the polishing head, the window plates may on rare occasions make unexpected contact with the wafer or retainer ring of the polishing head due to irregular vibrations during polishing, so that scratching occurs. Accordingly, in order to prevent this, it is desirable that at least the surfaces of the window plates that are located on the wafer side be coated with a hard coating.

A fourteenth embodiment of the present invention which is used in order to achieve the first aspect of the present invention is any of the first through thirteenth, which is further characterized by the fact that the transmissivity of the window plates with respect to the measurement light is 22% or greater.

In cases where measurement of the polished state or determination of the polishing endpoint is performed in situ using measurement light, the measurement light passes through the window plate and the slurry present on the window plate, and is then reflected by the object of polishing, so that the measurement light again passes through the slurry and window plate, after which the measurement light is detected by a detector. Considering the maximum value of the light that is ordinarily absorbed by the slurry present on the window plates, if the transmissivity of the window plates alone is not 22% or greater, the amount of emitted light that does not return to the detector will be 1% or greater, so that measurement may become unstable. Accordingly, it is desirable that the transmissivity of the window plates with respect to the measurement light be set at 22% or greater.

A fifteenth embodiment of the present invention which is used in order to achieve the first aspect is a polishing body which is characterized by the fact that in a polishing body used in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing, the polishing body comprising a material that is transparent to at least the measurement light in order to allow the passage of light used for the optical measurement of the polished surface of the object of polishing.

In the present invention, the polishing body itself is constructed from a material that is transparent to the measurement light; accordingly, there is no need to form opening parts in the polishing body in order to allow the passage of this measurement light. Consequently, there is no absorption of the measurement light as a result of the polishing agent flowing into opening parts, so that measurements can be performed using a light source whose light is weaker by a corresponding amount.

A sixteenth embodiment of the present invention which is used in order to achieve the first aspect is a polishing apparatus which is characterized by the fact that in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing, the polishing body is the polishing body of any one of the first through fifteenth embodiments.

In the present invention, the polishing body of any one of the first through fifteenth embodiments is used; accordingly, the actions and effects of the respective polishing bodies can be exhibited, so that the aspect of the present invention can be achieved.

A seventeenth embodiment of the present invention which is used in order to achieve the first aspect is the polishing apparatus of the sixteenth embodiment, which is further characterized by the fact that in an apparatus having a function in which measurement light is directed onto the object of polishing from a light-projecting device via the window plates and the opening parts, this light is reflected by the object of polishing, and the returning light that again passes through the opening parts and the window plates is received by a light-receiving device, the intensity of the light that is received during the polishing operation is 1% or more of the intensity of the projected light.

As a result, since there is no drop in the intensity of the light that returns to the light-receiving device, the polished thickness or polishing endpoint can be determined stably and with a high degree of precision utilizing the light signal that is detected by the light-receiving device. Furthermore, in order to perform an even more stable measurement, it is desirable that the intensity of the light that is received during the polishing operation be 5% or more of the intensity of the projected light.

An eighteenth embodiment of the present invention which is used in order to achieve the first aspect is the polishing apparatus of the sixteenth or seventeenth embodiments, which is further characterized by the fact that the window plates comprise a resin that has polishing characteristics comparable to the polishing characteristics of the polishing body.

As a result, even in cases where contact occurs between the window plates and the object of polishing (silicon wafer, etc.), the scratching of the polished surface of the object of polishing by the window plates, and non-uniform polishing, can be prevented.

A nineteenth embodiment of the present invention which is used in order to achieve the first aspect is a method used to adjust the gap between the outermost surface of the polishing body (i.e., the surface that contacts the object of polishing) and the surfaces of the window plates on the side of the outermost surface in a polishing apparatus which is the polishing apparatus of any of the sixteenth through eighteenth embodiments, and which has a function in which measurement light is directed onto the object of polishing from a light-projecting device via the window plates and the opening parts, this light is reflected by the object of polishing, and the returning light that again passes through the opening parts and the window plates is received by a light-receiving device; the polishing apparatus adjustment method being characterized by the fact that the method includes a stage in which the gap between the outermost surface of the polishing body and the surfaces of the window plates on the side of the outermost surface is adjusted on the basis of a signal measured by the light-receiving device.

In cases where the gap between the surfaces of the window plates on the side of the outermost surface of the polishing body and the outermost surface of the polishing body is too wide, the loss of light caused by the polishing agent that enters the recessed parts formed by the polishing body and the surfaces of the window plates on the side of the outermost surface of the polishing body becomes excessive, so that only an extremely weak signal can be obtained in the endpoint detection device. Accordingly, favorable measurement of the polished film thickness or polishing endpoint becomes impossible. On the other hand, in cases where the gap is too narrow, a signal caused by interference between the surfaces of the window plates on the side of the outermost surface and the layer of the polishing agent is added to the signal of the endpoint detection device; as a result, favorable measurement of the polished film thickness or polishing endpoint similarly becomes impossible.

In the present invention, the gap between the outermost surface of the polishing body (i.e., the surface that contacts the object of polishing) and the surfaces of the window plates on the side of the outermost surface is adjusted so that a signal that makes it possible to accomplish a favorable measurement of the polished film thickness or polishing endpoint while observing the signal of the light-receiving device can be measured by the endpoint detection device; accordingly, there are no problems of the type described above.

A twentieth embodiment of the present invention which is used in order to achieve the first aspect is a method for measuring the thickness of a polished film or the endpoint of polishing in which polishing is performed using the polishing apparatus of any one of the sixteenth through eighteenth embodiments, and the thickness of the polished film or endpoint of polishing is measured using a light signal received by a light-receiving device; this method being characterized by the fact that the signal measured by the measurement means that is used to measure the polished film thickness or polishing endpoint is not used in the measurement of the polished film thickness or polishing endpoint in cases where the signal measured by the measurement means is equal to a signal that is measured beforehand and stored in memory.

There may be instances in which the thickness of the polishing agent between the windows and the object of polishing is not constant during polishing, so that an inappropriate signal is obtained in the measurement of the polished film thickness or polishing endpoint. Examples of such inappropriate signals include extremely weak signals that are obtained in cases where the loss caused by the polishing agent is excessive, and signals to which is added a signal caused by interference of the layer of polishing agent present in the opening part on the window plate.

In the present invention, such inappropriate signals obtained during adjustment, etc., are stored in a memory device as pre-measured signals. During polishing, the signal measured by the measurement means is compared with the signals stored in the memory device, and in cases where measured signal is equal to any of the stored signals, the signal measured by the measurement means is not used in the measurement of the polished film thickness or the detection of the polishing endpoint. Accordingly, even in cases where the thickness of the polishing agent between the windows and the object of polishing is inconstant, so that the measurement might become unstable, erroneous measurement is eliminated in the measurement of the polished film thickness or polishing endpoint.

A twenty-first embodiment of the present invention which is used in order to achieve the first aspect is a polishing apparatus which is equipped with a polishing head that holds the object of polishing and a polishing body which is installed on a platen, and which polishes the object of polishing by causing relative motion between the polishing body and the object of polishing in a state in which a polishing agent is interposed between the polishing body and the object of polishing; this polishing apparatus being characterized by the fact that the apparatus has one or more opening parts formed in the platen, one or more opening parts formed in the polishing body, windows which are disposed so that they block at least portions of the opening parts formed in the polishing body, a device which measures the polished state by optically observing the polished surface of the object of polishing via the windows, and a moving device which moves the positions of the windows on the surface of the object of polishing, and the opening parts formed in the polishing body and the opening parts formed in the platen are superimposed, so that the windows are disposed on the platen via the moving device.

In the present invention, the gap between the surfaces of the windows on the side of the object of polishing and the polished surface of the object of polishing is controlled when the polished state of the object of polishing is observed by the device that measures the polished state by optically observing the polished surface of the object of polishing via the windows, so that the surfaces of the windows on the side of the object of polishing are not scratched by dressing or polishing, and so that a stable detection signal can be obtained. Accordingly, in-situ measurement of the polished state can be performed, and the frequency of replacement of the polishing body or windows can be reduced. As a result, the cost of polishing can be reduced.

A twenty-second embodiment of the present invention which is used in order to achieve the first aspect of the present invention is the twenty-first embodiment, which is characterized by the fact that the apparatus is further equipped with a device that senses the gap between the surfaces of the windows on the side of the object of polishing and the polished surface of the object of polishing, a device that senses the conditions of wear of the polishing body, or a device that senses both the gap and the conditions of wear.

As a result, the gap between the surfaces of the windows on the side of the object of polishing and the polished surface of the object of polishing can be sensed, so that the windows can be set in appropriate positions by means of the moving device. Accordingly, there is no scratching of the windows or object of polishing, and a stable detection signal can be obtained, so that in-situ measurement of the polished state is possible, and the frequency of replacement of the polishing body or windows can be reduced. As a result, the cost of polishing can be reduced.

A twenty-third embodiment of the present invention which is used in order to achieve the first aspect of the present invention is the twenty-second embodiment, which is characterized by the fact that the apparatus is further equipped with a control device that controls the gap between the surfaces of the windows on the side of the object of polishing and the polished surface of the object of polishing.

In the present invention, the gap between the surfaces of the windows on the side of the object of polishing and the polished surface of the object of polishing can be controlled by means of a control device. Accordingly, there is no scratching of the windows or object of polishing, and a stable detection signal can be obtained, so that in-situ measurement of the polished state is possible, and the frequency of replacement of the polishing body or windows can be reduced. As a result, the cost of polishing can be reduced.

A twenty-fourth embodiment of the present invention which is used in order to achieve the first aspect of the invention is the twenty-third embodiment, which is further characterized by the fact that the apparatus has a function which predicts the amount of wear of the polishing body from the polishing conditions, polishing time, dressing conditions and dressing time, and controls the gap between the surfaces of the above-mentioned windows on the side of the object of polishing and the polished surface of the object of polishing.

In the present invention, there is no scratching of the windows or object of polishing as a result of polishing or dressing, and a stable detection signal can be obtained, so that in-situ measurement of the polished state is possible, and the frequency of replacement of the polishing body or windows can be reduced. As a result, the cost of polishing can be reduced.

A twenty-fifth embodiment of the present invention which is used in order to achieve the first aspect of the present invention is the twenty-third embodiment, which is further characterized by the fact that the apparatus has a function which controls the moving device so that the gap between the surfaces of the above-mentioned windows on the side of the object of polishing and the polished surface of the object of polishing is maintained at a constant value.

In the present invention, there is no scratching of the windows or object of polishing as a result of polishing or dressing, and a stable detection signal can be obtained, so that in-situ measurement of the polished state is possible, and the frequency of replacement of the polishing body or windows can be reduced. As a result, the cost of polishing can be reduced.

A twenty-sixth embodiment of the present invention which is used to achieve the first and second aspects of the present invention is the twenty-third embodiment, which is further characterized by the fact that the apparatus has a function which controls the gap between the surfaces of the windows on the side of the object of polishing and the polished surface of the object of polishing in synchronization with the rotation of the platen.

In the present invention, there is no scratching of the windows or object of polishing as a result of polishing or dressing, and a stable detection signal can be obtained, so that in-situ measurement of the polished state is possible, and the frequency of replacement of the polishing body or windows can be reduced. As a result, the cost of polishing can be reduced.

The means which is used in order to achieve the second aspect is a semiconductor device manufacturing method in which the use of at least one of the apparatuses or methods of the present inventions in the sixteenth through twenty-sixth embodiments is included in the manufacture process.

In the present invention, the polished state and polishing endpoint can be stably detected in the wafer polishing process; accordingly, accurate wafers can be manufactured. Furthermore, since there tends to be no scratching of the windows through which the light used to detect the polished state and polishing endpoint passes, the frequency of replacement of the polishing body is reduced, so that the throughput can be increased, and costs can be reduced. At the same time, there tends to be no scratching of the wafer, either; accordingly, the wafer yield can be increased.

BRIEF DESCRIPTION OF THE DRAWINGS

FIGS. 15A–K shows examples of the processes used to manufacture the polishing body of the present invention.

DETAILED DESCRIPTION OF THE PREFERRED EMBODIMENTS

Below, examples will be described with reference to the attached figures in order to describe the present invention in greater detail. However, the present invention is described here in terms of examples and embodiments, and this description should not be interpreted as limiting the content of the invention.

First, examples and embodiments of the invention for the purpose of achieving the first aspect of the present invention will be described.

Example 1—1

Figure 3:
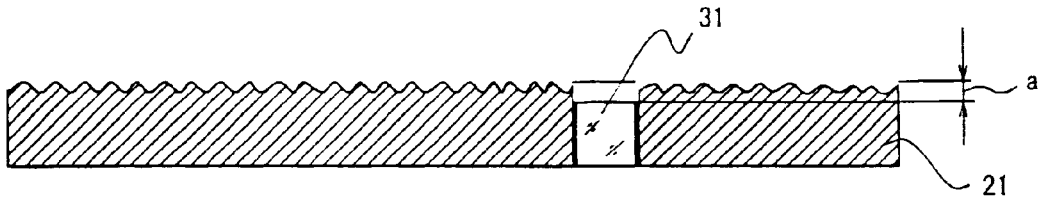
FIG. 3 illustrates a first example of a polishing pad (polishing body) of the present invention.
Figure 4A:
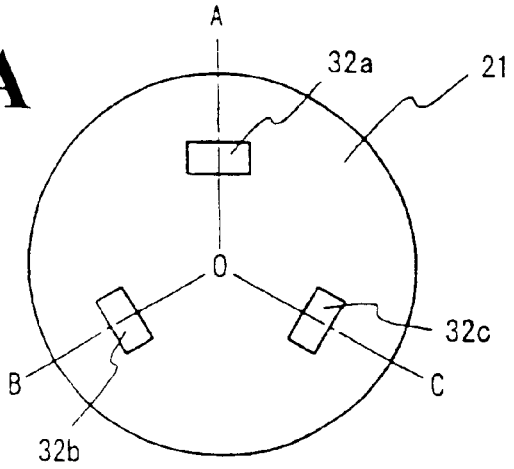
FIGS. 4A–D illustrate a second example of a polishing pad (polishing body) of the present invention.
Figure 4B:
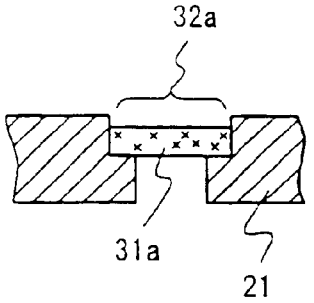
Figure 4C:
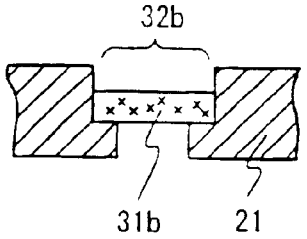
Figure 4D:
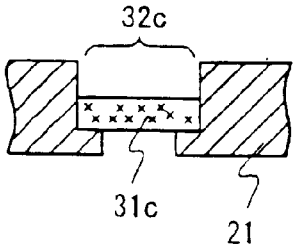

FIG. 3 is a diagram which is used to illustrate a first example of a polishing pad (polishing body) of the present invention. In the following figures, constituent elements that are the same as constituent elements shown in preceding figures are labeled with the same symbols, and a description of such constituent elements may be omitted. In FIG. 3, 21 indicates a polishing pad, and 31 indicates a transparent window plate.

Figure 2:
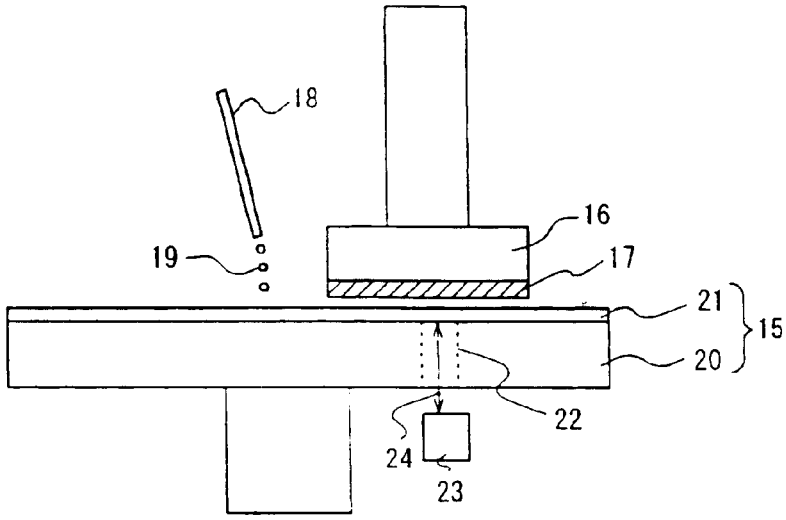
FIG. 2 is a schematic structural diagram of a polishing (planarization) apparatus used in CMP.

The transparent window plate 31 is fit into a hole that is bored in the polishing pad 21. Here, a gap $\alpha$ is left between the upper surface of the transparent window plate 31 and the outermost surface that constitutes the working surface of the polishing pad 21. During polishing, a polishing head 16 which holds the wafer 17 as shown in FIG. 2 is caused to apply a load to the polishing pad by means of a load-applying mechanism (not shown in the figures), so that the polishing pad 21 and transparent window plate 31 are compressed. In this case, it is desirable that the gap $\alpha$ be as constant as possible, and that a dimension that is equal to or greater than a standard value be maintained.

A soft polishing pad made of a foam urethane is not very desirable as the polishing pad. The reason for this is as follows: widely used soft polishing pads made of a foam urethane generally show a large amount of compressive deformation of the polishing pad due to the load applied during polishing. Accordingly, not only is it necessary to set the gap $\alpha$ that exists in an unloaded/non-compressed state at a large value, but the amount of flexing that occurs in response to dynamic forces such as irregular vibration of the wafer or retainer ring of the polishing head, etc., during loading/polishing is large, so that it is also necessary to prevent scratching that might be caused by the polished surface of the wafer or the retainer ring of the polishing head contacting the upper surface of the window plate when maximum flexing occurs. Consequently, the gap $\alpha$ that exists during the loading/compression of polishing must be set at a relatively large value, and the slurry enters the space created by this gap $\alpha$ on the surface of the transparent window plate 31, so that the measurement light must pass through this slurry. Consequently, the rate of transmission of the measurement light drops.

From the above standpoint, it is desirable to use a hard polishing pad in which the amount of compressive deformation is small as the polishing pad. The reason for this is as follows: in such a case, since the amount of compressive deformation is small for the polishing load, the gap $\alpha$ that exists in an unloaded/non-compressed state can be kept at a small value; furthermore, since the amount of flexing that occurs in response to dynamic forces such as irregular vibration of the wafer or retainer ring of the polishing head during polishing is small even when the polishing load is applied, the gap $\alpha$ that exists in the loaded/compressed state can be kept to a small value. If the gap $\alpha$ that exists in the loaded/compressed state can be reduced, the transmissivity with respect to the measurement light is increased, which is desirable for high-precision and stable measurement of the polished state.

The thickness of the window plate must be varied in accordance with the thickness of the polishing pad. The transmissivity of the window plate 31 with respect to the measurement light and the slurry present in the recessed part on the surface of the window plate 31 depends on the gap $\alpha$ that exists in the loaded/compressed state, the concentration of the slurry and the thickness and material of the window plate.

In order to achieve high-precision and stable measurement of the polished state, it is desirable that the transmissivity of the window plate 31 be 22% or greater. It is desirable that the combined transmissivity of both the window plate 31 and the slurry present in the recessed part on the window plate with respect to the measurement light be 10% or greater (1% or greater in terms of round-trip transmissivity) in the loaded/compressed state. However, in cases where the intensity of the light source is strong, or in cases where the sensitivity of the sensor is high, measurement is possible even if this transmissivity is less than 10%.

If a transparent material is selected as the window plate material, then the above-mentioned transmissivity with respect to the measurement light depends substantially on the concentration of the slurry that enters the recessed part formed above the window plate 31 and the thickness of the slurry layer in the loaded/compressed state.

The permissible value of the gap $\alpha$ depends on the slurry concentration; however, in the case of a common slurry concentration, it is desirable that this gap be 0 to 400 $\mu$m. The reason that this gap is set at a value greater than zero is to prevent the window plate 31 from contacting the object of polishing or the diamond grinding wheel during dressing. The reason that this gap is set at 400 $\mu$m or less is to avoid attenuation of the measurement light by the slurry. Furthermore, for the same reasons, it is even more desirable that the gap $\alpha$ be set at 10 to 200 $\mu$m. The value of this gap $\alpha$ is generally large in the case of a soft polishing pad made of a foam urethane, and small in the case of a non-foam hard polishing pad.

Furthermore, in spite of the fact that the above-mentioned gap $\alpha$ is determined with the load during polishing taken into account so that the window plate does not contact the wafer or the retainer ring of the polishing head, the window plate may on rare occasions make unexpected contact with the wafer or retainer ring of the polishing head due to irregular vibrations during polishing, so that scratching occurs. Accordingly, in order to prevent this, it is desirable that at least the surface of the window plate that is located on the wafer side be coated with a hard coating. For example, in the case of an acrylic resin, a method in which a hard coating is applied by means of a silicone type organic resin is desirable.

The polishing pad described above is desirable for use in cases where the material of the polishing pad itself is opaque to the measurement light. It goes without saying that such measurement window parts are unnecessary in the case of a polishing pad in which the material of the polishing pad is transparent to the measurement light.

In the case of the polishing pad of the present example, a polishing pad of the configuration shown in FIG. 3 may be fastened to the platen 20 of the polishing apparatus shown in FIG. 2 and used "as is", or may be used after being fastened to the platen 20 in a form in which the polishing pad is caused to flow into the platen (comprising an aluminum plate, etc.). Alternatively, a polishing pad backed by one or more layers of other appropriate different materials may be fastened to the platen 20 and used.

Thus, in the polishing apparatus shown in FIG. 2, the state of polishing can be favorably measured by the polished-state measuring device 23 during polishing, as a result of the desirable function of the polishing pad 21 fastened to the platen 20.

Furthermore, in regard to the relationship between the intensity of the measurement light 24 that is emitted from the polished-state measuring device 23 and the intensity of the light that passes through the window plate 31, passes through the polishing agent in the recessed part formed on the window plate 31, is reflected by the polished surface of the object of polishing 17, again passes through the polishing agent in the above-mentioned recessed part and the window plate 31 and returns to the polished-state measuring device 23, it is desirable that the ratio of the intensity of the light that returns to the polished-state measuring device 23 to the intensity of the measurement light 24 emitted from the polished-state measuring device 23 be 1% or greater, and a ratio of 5% or greater is even more desirable. In this way, the intensity of the light that returns to the polished-state measuring device 23 does not drop, so that high-precision and stable measurement of the polished state can be accomplished by means of the polished-state measuring device 23.

Example 1-2

FIG. 4 is a diagram which is used to illustrate a second example of a polishing pad (polishing body) of the present invention. FIG. 4(*a*) is a plan view, FIG. 4(*b*) is a sectional view of the portion indicated by line A–O in FIG. 4(*a*), FIG. 4(*c*) is a sectional view of the portion indicated by line B–O in FIG. 4(*a*), and FIG. 4(*d*) is a sectional view of the portion indicated by line C–O in FIG. 4(*a*). In FIG. 4, 31*a* through 31*c* indicate window plates, and 32*a* through 32*c* indicate opening parts.

In the present example, the polishing body 21 has three opening parts 32*a*, 32*b* and 32*c*. Furthermore, a window plate 31*a* is disposed in the opening part 32*a*, a window plate 31*b* is disposed in the opening part 32*b*, and a window part 31*c* is disposed in the opening part 32*c*. In FIGS. 4(*b*), (*c*) and (*d*), the surface on the upper side of the polishing body 21 is the top surface of the polishing body 21, and the surfaces on the upper sides of the window plates 31*a* through 31*c* are the surfaces of the window plates that are located on the side of the object of polishing.

The surfaces of the respective window plates 31*a* through 31*c* are recessed with respect to the surface of the polishing body 21, and the respective amounts of recess are different in each of the opening parts 32*a* through 32*c*. As a result, the amount of recess for each of the opening parts 32*a* through 32*c* varies in a stepwise manner. In the polishing body 21 of the present working configuration, the amounts of recess of the surfaces of the window plates 31*a* through 31*c* on the side of the object of polishing with respect to the surface of the polishing body 21 are set so that the amount of recess is smallest in the case of the window plate 31*a* of the opening part 32*a*, and largest in the case of the window plate 31*c* of the opening part 32*c*. The amount of recess of the window plate 31*b* of the opening part 32*b* is more or less intermediate between the amount of recess of the opening part 31*a* and the amount of recess of the opening part 32*c*.

Such a polishing body 21 is attached to the polishing apparatus shown in FIG. 2 and used. The polishing body 21 is bonded to the platen 20 by means of a two-sided tape or an adhesive agent. Furthermore, the window plates and opening parts disposed in the polishing body 21 are omitted from FIG. 2. The opening parts 22 formed in the platen 20 and the opening parts 32*a* through 32*c* formed in the polishing body 21 are superimposed.

In the initial state immediately following the initiation of polishing, the area of the opening part 32*a*, in which the amount of recess of the surface of the window on the side of the object of polishing with respect to the surface of the polishing body is smallest, is used to observe the state of the polished surface. In this way, the state of the polished surface is observed by means of the light that passes through the window plate 31*a* installed in the opening part 32*a* (among the light that returns to the polished-state measuring device 23 after being emitted from the polished-state measuring device 23 and reflected by the silicon wafer (object of polishing) 17).

A position detection sensor (not shown in the figures) is installed on the platen 20. When the platen 20 rotates so that a specified position on the platen 20 reaches the position of the position detection sensor, the position detection sensor outputs a trigger signal. The time interval required for the platen 20 to rotate from the position of the platen 20 at which the position detection sensor outputs a trigger signal to the position at which the opening part 32*a* reaches a point above the polished-state measuring device 23 is determined by the rpm of the platen 20.

Accordingly, the above-mentioned time interval can be calculated or measured beforehand, and the polished-state measuring device 23 can be actuated after this time interval has elapsed following the output of the trigger signal by the position detection sensor. As a result, it is always possible to detect the polishing endpoint or measure the film thickness at the opening part 32*a*.

Each time the polishing of one silicon wafer is completed, the polishing body is dressed. A diamond grinding wheel, etc., is used for this dressing. After dressing is performed, the next silicon wafer that is to be polished is attached to the polishing head 16, and polishing is performed. Thus, the polishing and dressing processes are alternately repeated.

Each time dressing is performed, the surface of the polishing body 21 is ground away, so that the amount of recess above the window plate 31*a* in the opening part 32*a* with respect to the surface of the polishing body 21 becomes progressively smaller. When the amount of recess reaches zero, scratching of the surface of the window plate 31*a* on the side of the object of polishing begins to be caused by dressing. Furthermore, when such scratching of the window occurs, the scattering, etc., of light in the area of the window increases, so that the precision of polishing endpoint detection and the precision of film thickness measurement drop.

Accordingly, a switch is made so that polishing endpoint detection or film thickness measurement is accomplished using the opening part 32*b*, which has the second smallest amount of recess in the initial state. Such a switch so that polishing endpoint detection or film thickness measurement is performed using the opening part 32*b* can be accomplished by changing the time interval from the output of the trigger signal by the position detection sensor installed on the platen 20 to the actuation of the polished-state measuring device 23 to the appropriate time interval, and actuating the polished-state measuring device 23 when the opening part 32*b* arrives at a point above the polished-state measuring device 23.

Then, the polishing process and dressing process are repeated, and when the amount of recess of the surface of the window plate 31*b* on the side of the object of polishing in the opening part 32*b* also reaches zero, so that scratching of the surface of the window plate 31*b* on the side of the object of polishing begins to be caused by dressing, another switch is made so that polishing endpoint detection or film thickness measurement is accomplished using the opening part 32*c*, which has the largest amount of recess of the window in the initial state. The switching of polishing endpoint detection or film thickness measurement from the opening part 32*b* to the opening part 32*c* can be accomplished in the same manner as the above-mentioned switch from the opening part 32*a* to the opening part 32*b*. Thus, since the surfaces (on the side of the object of polishing) of the windows installed in the opening parts that are used for polishing endpoint detection and film thickness measurement are recessed with respect to the surface of the polishing body during dressing, there is no scratching of the windows during dressing.

Furthermore, it would also be possible to perform the switching of the opening parts by installing a control device that switches to the next opening part when the amount of light received by the polished-state measuring device 23 drops below a predetermined set value.

Furthermore, in the present example, the platen 20 has three opening parts, and the polishing body 21 has three opening parts in which windows are installed. However, the respective numbers of these opening parts may be two opening parts, or four or more opening parts. In such cases, the observation of the polished state can be switched a number of times corresponding to the number of opening parts.

In the polishing apparatus in which the polishing body of the present example is installed, a plurality of windows with different amounts of recess for each opening part are disposed in the polishing body 21; accordingly, even if a certain window should be scratched by dressing so that this window becomes optically opaque, polishing endpoint detection or film thickness measurement can be accomplished by switching the window used for polishing endpoint detection or film thickness measurement to the window of another opening part. As a result, the same polishing body can be used in polishing for a longer period of time than is possible in the case of a conventional polishing body, so that the frequency of replacement of the polishing body or windows is reduced, thus making it possible to reduce the cost of polishing.

Example 1-3

Figure 5A:
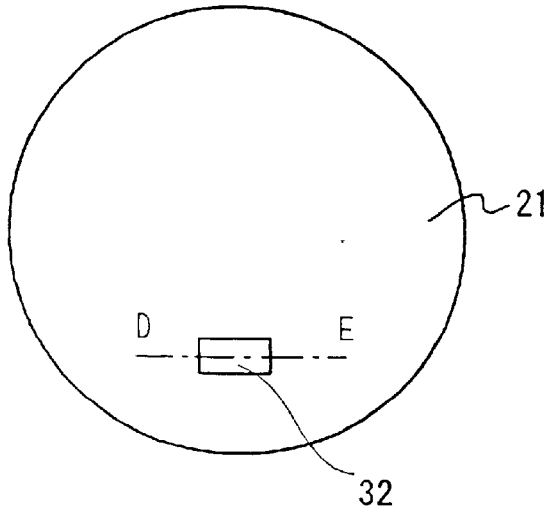
FIGS. 5A and 5B illustrate a third example of a polishing pad (polishing body) of the present invention.
Figure 5B:
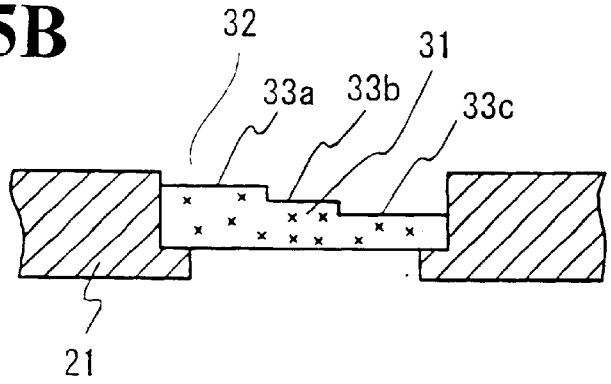

FIG. 5 is a diagram which is used to illustrate a third example of a polishing pad (polishing body) of the present invention. FIG. 5(*a*) is a plan view, and FIG. 5(*b*) is a sectional view of the portion indicated by line D–E in FIG. 5(*a*). In FIG. 5, 32 indicates an opening part, and 33*a* through 33*c* indicate respective parts of a window plate 31.

The polishing body 21 of the present example has a single opening part 32. The window plate 31 disposed in this opening part 32 has a step-form cross section, so that the amount of recess of the surface of the window plate 31 on the side of the object of polishing with respect to the surface of the polishing body 21 differs in the three parts 33*a*, 33*b* and 33*c*. The amount of recess of the surface of the window plate 31 on the side of the object of polishing with respect to the surface of the polishing body 21 is smallest in the part 33*a*, and largest in the part 33*c*. In the part 33*b*, this amount of recess is more or less intermediate between that in the part 33*a* and that in the part 33*c*. As a result, the amount of recess of the surface of the window plate 31 on the side of the object of polishing varies in a stepwise manner.

In cases where a polymer resin is used as the material of the window plate 31, a window plate 31 which has a step-form difference in the surface can be manufactured by causing the resin to flow in a liquid state into a mold that has step differences, and then curing the resin.

Such a polishing body is attached to the polishing apparatus shown in FIG. 2 and used. In this case, an opening part 22 formed in the platen 20 is arranged so that it is superimposed on the opening part 32 formed in the polishing body 21.

In the initial state immediately following the initiation of polishing, the part 33*a*, in which the amount of recess of the surface of the window plate 31 on the side of the object of polishing with respect to the surface of the polishing body is smallest, is used for the observation of the state of the polished surface. As a result, the state of the polished surface is observed using the light that passes through the part 33*a* of the window plate 31 (among the light that is emitted from the polished-state measuring device 23, reflected by the polished surface of the silicon wafer 17 and returned to the polished-state measuring device 23). A position detection sensor (not shown in the figures) is installed on the platen 20 in the same manner as in the polishing apparatus described in Working Configuration 1–2. The time interval required for the platen 20 to rotate from the position of the platen 20 at which the position detection sensor outputs a trigger signal to the position at which the part 33*a* of the window plate 31 installed in the opening part reaches a point above the polished-state measuring device 23 is determined by the rpm of the platen 20. Accordingly, as in Example 1–2, the time interval can be calculated or measured beforehand, and the polished-state measuring device 23 can be actuated after this time interval has elapsed following the output of the trigger signal by the position detection sensor.

In this example, as in Example 1–2, the polishing process and dressing process are repeated. Each time dressing is performed, the surface of the polishing body 21 is ground away, so that the amount of recess in the part 33*a* of the window plate 31 in the opening part 32 with respect to the surface of the polishing body 21 becomes progressively smaller. When the amount of recess reaches zero, scratching of the part 33*a* of the window plate 31 begins to be caused by dressing. As a result, the scattering, etc., of light in the part 33*a* increases, so that the precision of polishing endpoint detection and the precision of film thickness measurement drop.

Accordingly, a switch is made so that polishing endpoint detection or film thickness measurement is accomplished using the part 33*b* of the window plate 31, in which the amount of recess in the initial state is second smallest. Such a switch so that polishing endpoint detection or film thickness measurement is performed using the part 33*b* of the window plate 31*c* an be accomplished by changing the time interval from the output of the trigger signal by the position detection sensor installed on the platen 20 to the actuation of the polished-state measuring device 23 to the appropriate time interval, and actuating the polished-state measuring device 23 when the part 33*b* of the window plate 31*a* arrives at a point above the polished-state measuring device 23.

Then, the polishing process and dressing process are repeated, and when the amount of recess of the part 33*b* of the window plate 31 also reaches zero, so that scratching of the part 33*b* of the window plate 31 begins to be caused by dressing, another switch is made so that polishing endpoint detection or film thickness measurement is accomplished using the part 33*c*, which has the largest amount of recess of any part of the window plate 31 in the initial state. Thus, since the surfaces (on the side of the object of polishing) of respective parts of the window installed in the opening part that are used for polishing endpoint detection and film thickness measurement are recessed with respect to the surface of the polishing body during dressing, there is no scratching of these parts during dressing.

Furthermore, in the present example, the polishing body 21 has a step-form window plate 31 whose surface has three steps in the opening part. However, the number of steps may also be two steps, or four or more steps. In such cases, the observation of the polished state can be switched a number of times corresponding to the number of steps.

In a polishing apparatus which uses the polishing body of such an example, a window with a step-form surface is installed in the polishing body; accordingly, even if one part of the window should be scratched by dressing so that this part of the window becomes optically opaque, polishing endpoint detection or film thickness measurement can be accomplished by switching the part of the window used for the observation by the polished-state measuring device 23. As a result, the same polishing body can be used in polishing for a longer period of time than is possible in the case of a conventional polishing body, so that the frequency of replacement of the polishing body or windows is reduced, thus making it possible to reduce the cost of polishing.

In the polishing apparatus of this example, it would also be possible to perform the switching of the parts of the window plate 31 by installing a control device that switches to the next part of the window plate when the amount of light received by the polished-state measuring device 23 drops below a predetermined set value, as in Example 12.

Example 1-4

Figure 6A:
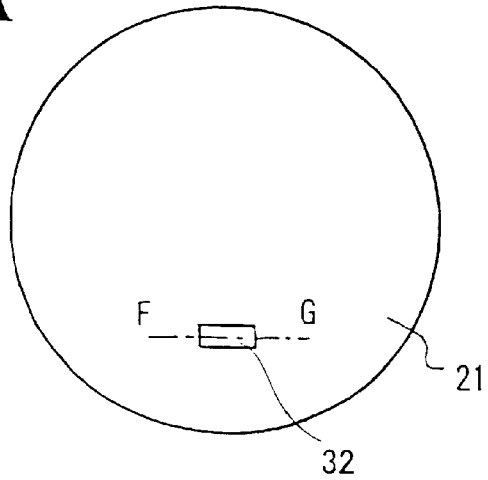
FIGS. 6A and 6B illustrate a fourth example of a polishing pad (polishing body) of the present invention.
Figure 6B:
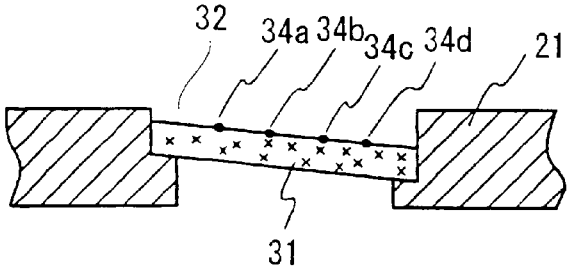

FIG. 6 is a diagram which is used to illustrate a fourth example of a polishing pad (polishing body) of the present invention. FIG. 6(*a*) is a plan view, and FIG. 6(*b*) is a sectional view of the portion indicated by line F–G in FIG. 6(*a*). In FIG. 6, 34*a* through 34*d* are points on the surface of the window plate 31.

The polishing body 21 of the present example has a single opening part. The parallel flat-plate window plate 31 installed in this opening part is devised so that it is inclined in section, with the amount of recess from the surface of the polishing body varying in the F–G direction in FIG. 6(*a*). As a result, the amount of recess of the surface of the window plate 31 on the side of the object of polishing varies in a continuous manner. In a case where four places 34*a*, 34*b*, 34*c* and 34*d* are designated on the surface of the window plate 31, the amount of recess of the surface of the window on the side of the object of polishing with respect to the surface of the polishing body is smallest in the area of 34*a*, second smallest in the area of 34*b*, third smallest in the area of 34*c*, and greatest in the area of 34*d*.

Such a polishing body 21 is used as the polishing body of the polishing apparatus shown in FIG. 2. In this case as well, the apparatus is arranged so that the opening part 22 in the platen 20 is superimposed on the opening part 32 in the polishing body 21.

In the initial state immediately following the initiation of polishing, the area of 34*a* in which the amount of recess of the surface of the window 31 on the side of the object of polishing with respect to the surface of the polishing body is smallest is used for the observation of the state of the polished surface. As a result, the state of the polished surface is observed using the light that passes through the area of 34*a* on the window plate 31 (among the light that is emitted from the polished-state measuring device 23, reflected by the polished surface of the silicon wafer 17 and returned to the polished-state measuring device 23). A position detection sensor (not shown in the figures) is installed on the platen 20 in the same manner as in the polishing apparatus according to Working Configuration 1–2. The time interval required for the platen 20 to rotate from the position of the platen 20 at which the position detection sensor outputs a trigger signal to the position at which the area of 34*a* on the window 31 installed in the opening part reaches a point above the polished-state measuring device 23 is determined by the rpm of the platen 20. Accordingly, as in Example 1–2, the above-mentioned time interval can be calculated or measured beforehand, and the polished-state measuring device 23 can be actuated after this time interval has elapsed following the output of the trigger signal by the position detection sensor.

Furthermore, as in Example 1–2, the polishing process and dressing process are repeated.

Each time dressing is performed, the surface of the polishing body 21 is ground away, so that the amount of recess in the area of 34*a* on the window plate 31 in the opening part with respect to the surface of the polishing body 21 becomes progressively smaller. When the amount of recess reaches zero, scratching of the area of 34*a* on the window plate 31 begins to be caused by dressing. As a result, the precision of polishing endpoint detection and the precision of film thickness measurement drop. Accordingly, a switch is made so that polishing endpoint detection or film thickness measurement is accomplished using the area of 34*b* on the window plate 31, in which the amount of recess is second smallest. Such a switch so that polishing endpoint detection or film thickness measurement is performed using the area of 34*b* on the window plate 31*c* an be accomplished by changing the time interval from the output of the trigger signal by the position detection sensor installed on the platen 20 to the actuation of the polished-state measuring device 23 to the appropriate time interval, and actuating the polished-state measuring device 23 when the area of 34*b* on the window plate 31*a* arrives at a point above the polished-state measuring device 23.

Then, the polishing process and dressing process are repeated, and when the amount of recess in the area of 34*b* on the window plate 31 also reaches zero, so that scratching in the area of 34*b* on the window plate 31 begins to be caused by dressing, another switch is made so that polishing endpoint detection or film thickness measurement is accomplished using the area of 34*c* on the window plate 31, in which the amount of recess is third smallest. Th polishing process and dressing process are then further repeated, and when amount of recess in the area of 34*c* on the window plate 31 also reaches zero, so that scratching in the area of 34*c* on the window plate 31 begins to be caused by dressing, another switch is made so that polishing endpoint detection or film thickness measurement is accomplished using the area of 34*d* on the window plate 31, in which the amount of recess is largest. Thus, since the surfaces (on the side of the object of polishing) of the areas of the window installed in the opening part that are used for polishing endpoint detection or film thickness measurement are recessed with respect to the surface of the polishing body during dressing, these areas are not scratched during dressing.

Furthermore, in the present example, switching was performed among four locations on the window; however, the number of locations involved in this switching may also be two or three locations, or more than four locations. In such cases, the observation of the polished state can be switched a number of times corresponding to the number of areas used for measurement.

In a polishing apparatus which uses such a polishing body, parallel flat-plate-form window is installed in the polishing body so that the surface of this window is inclined; accordingly, even if one area on the window should be scratched by dressing so that this area on the window becomes optically opaque, polishing endpoint detection or film thickness measurement can be accomplished by switching the area on the window used for the observation by the polished-state measuring device 23. As a result, the same polishing body can be used in polishing for a longer period of time than is possible in the case of a conventional polishing body, so that the frequency of replacement of the polishing body or windows is reduced, thus making it possible to reduce the cost of polishing.

In the polishing apparatus of this example, it would also be possible to perform the switching of the areas on the window plate 31 by installing a control device that switches to the next area on the window plate when the amount of light received by the polished-state measuring device 23 drops below a predetermined set value, as in Example 12.

Example 1-5

Figure 7A:
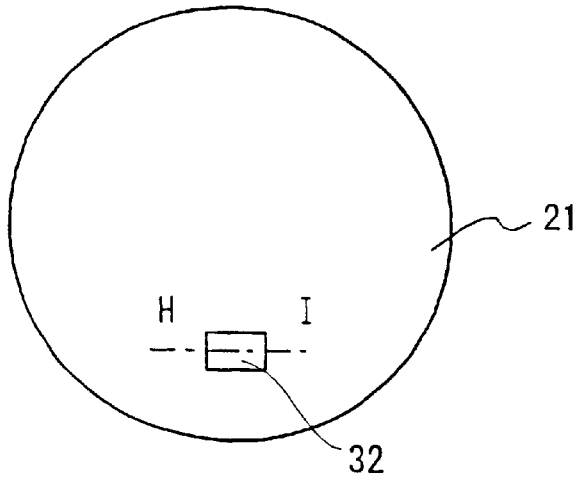
FIGS. 7A and 7B illustrate a fifth example of a polishing pad (polishing body) of the present invention.
Figure 7B:
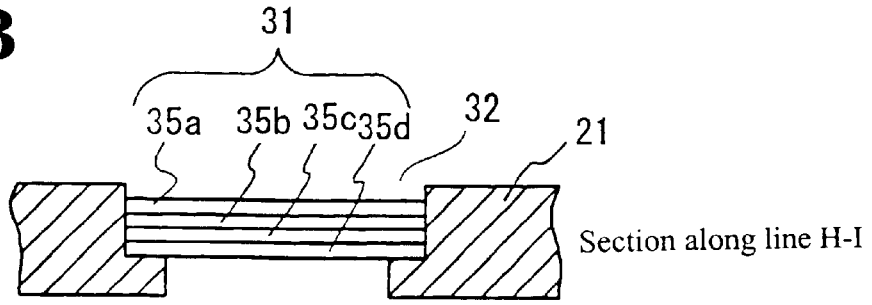

FIG. 7 is a diagram which is used to illustrate a fifth example of a polishing pad (polishing body) of the present invention. FIG. 7(*a*) is a plan view, and FIG. 7(*b*) is a sectional view of the portion indicated by line H–I in FIG. 7(*a*). In FIG. 7, 35*a* through 35*d* indicate sheets of a transparent material.

The polishing body 21 of the present example has a single opening part 32. The parallel flat-plate-form window plate 31 which is installed in this opening part 32 has a structure in which four sheets 35*a* through 35*d* of a transparent material are laminated with an adhesive strength that allows peeling of the sheets. The transparent material sheets 35*a* through 35*d* are bonded by means of an adhesive agent or two-sided tape, etc., which has an adhesive strength that allows peeling of the sheets. The amount of recess of the surface of the window plate 31 on the side of the object of polishing with respect to the surface of the polishing body 21 is varied in a stepwise manner by peeling away the transparent material sheets 35*a* through 35*d* one at a time from the top.

Such a polishing body 21 is used as the polishing body of the polishing apparatus shown in FIG. 2. In this case as well, the apparatus is arranged so that the opening part 22 in the platen 20 is superimposed on the opening part 32 in the polishing body 21.

In the initial state immediately following the initiation of polishing, the window with four laminated transparent material sheets 35*a* through 35*d* is used for the observation of the state of the polished surface. As a result, the state of the polished surface is observed using the light that passes through the window in which these four transparent material sheets 35*a* through 35*d* are laminated (among the light that is emitted from the polished-state measuring device 23, reflected by the polished surface of the silicon wafer 17 and returned to the polished-state measuring device 23). The mechanism and method which perform polishing endpoint detection or film thickness measurement utilizing the opening parts formed in the platen 20 and polishing body 21 as the platen 20 rotates are the same as in Example 1–2; accordingly, a description is omitted here.

Furthermore, as in Example 1–2, the polishing process and dressing process are repeated. Each time dressing is performed, the surface of the polishing body is ground away, so that the amount of recess of the surface (on the side of the object of polishing) of the transparent material sheet 35*a* of the window plate 31 in the opening part with respect to the surface of the polishing body 21 decreases, and when this amount of recess reaches zero, the surface of the transparent material sheet 35*a* begins to be scratched by dressing. As a result, the scattering, etc., of light in the transparent material sheet 35*a* increases, so that the precision of polishing endpoint detection and the precision of film thickness measurement drop. Accordingly, the transparent material sheet 35*a* is peeled away from the laminated window plate 31, so that polishing endpoint detection or film thickness measurement is subsequently performed with the transparent material sheet 35*b* as the uppermost surface of the window. As a result, the surface of the window plate 31 that is obtained is a surface of the window plate 31 that is recessed from the surface of the polishing body 21 and that is unscratched, so that polishing endpoint detection or film thickness measurement can be performed in a normal manner. Furthermore, since the same position on the window plate 31 of the same opening part can be used for polishing endpoint detection or film thickness measurement in the polishing apparatus of the present working configuration, there is no need to switch the window position used for polishing endpoint detection or film thickness measurement as in the polishing apparatuses of Examples 1-2 through 1-4.

Then, the polishing process and dressing process are repeated, and when the amount of recess of the surface of the transparent material sheet 35*b* of the window plate 31 on the side of the object of polishing also reaches zero, so that the transparent material sheet 35*b* begins to be scratched by dressing, the transparent material sheet 35*b* is peeled from the window plate 31, so that polishing endpoint detection or film thickness measurement is subsequently performed with the transparent material sheet 35*c* as the uppermost surface of the window. The polishing process and dressing process are then further repeated, and when the amount of recess of the surface of the transparent material sheet 35*c* of the window plate 31 on the side of the object of polishing also reaches zero, so that the transparent material sheet 35*c* begins to be scratched by dressing, the transparent material sheet 35*c* is peeled from the window plate 31, so that polishing endpoint detection or film thickness measurement is subsequently performed with the transparent material sheet 35*d* as the uppermost surface of the window plate 31. Thus, since the surface (on the side of the object of polishing) of the part of the window installed in the opening part that is used for polishing endpoint detection or film thickness measurement is recessed with respect to the surface of the polishing body during dressing, there is no scratching of this part during dressing.

Furthermore, in order to ascertain the timing at which the parts 35*a*, 35*b* and 35*c* of the window are peeled away, it would also be possible to install a control device which outputs a signal that indicates the peeling timing when the amount of light received by the polished-state measuring device 23 drops below a predetermined set value.

Furthermore, in the present example, a window is used in which four transparent material sheets 35*a* through 35*d* are laminated in the window plate 31; however, it would also be possible to use a window in which two or three sheets or five or more sheets of a transparent material are laminated. In such cases, the observation of the polished state can be switched a number of times corresponding to the number of transparent material sheets used.

Furthermore, in cases where the amount of recess of the surface of the window plate 31 on the side of the object of polishing with respect to the surface of the polishing body 21 exceeds 400 $\mu$m, the amount of polishing agent that accumulates in the recessed part becomes excessively large, and this polishing agent acts as a scattering body, so that the light 24 emitted from the polished-state measuring device 23 is attenuated, thus causing a drop in the precision of polishing endpoint detection and the precision of film thickness measurement. Accordingly, it is desirable that the amount of recess d of the portion of the window plate 31 through which the light from the polished-state measuring device 23 passes (i.e., the portion used for polishing endpoint detection or film thickness measurement) be such that $0\ \mu m < d \leqq 400\ \mu m$. Accordingly, except for the lowermost transparent material sheet 35*d*, it is desirable that the respective thicknesses t1 of the transparent material sheets 35*a* through 35*c* that are peeled away be such that $0\ \mu m < t1 \leqq 400\ \mu m$.

Thus, in a polishing apparatus which uses the polishing body of the present example, a window in which sheets of a transparent material are laminated is installed in the polishing body; accordingly, even if the surface of the window on the side of the object of polishing should be scratched by dressing so that this surface becomes optically opaque, polishing endpoint detection or film thickness measurement can be accomplished by peeling away the transparent material constituting the uppermost layer of the laminated window. As a result, compared to conventional polishing bodies, the same polishing body can be used in polishing for a long period of time, so that the frequency of replacement of the polishing body or window can be reduced; accordingly, the cost of polishing can be reduced.

In the Examples 1—1 through 1-5, it is desirable that the material of the polishing pad (polishing body) comprises one or more materials selected from a set comprising epoxy resins, acrylic resins, ABC resins, vinyl chloride resins, polycarbonate resins, polyester resins, fluororesins and polyurethane resins.

A transparent material such as glass, quartz glass, acrylic, polyurethane, epoxy, PET, vinyl chloride, polycarbonate, polyester or silicone rubber, etc., is used as the window plate material. Furthermore, it is desirable that the polishing characteristics (polishing rate and hardness, etc.) of such transparent materials be comparable to the polishing characteristics of the polishing body. In this way, even if the window should contact the silicon wafer constituting the object of polishing, there will be no non-uniform polishing or scratching of the polished surface of the silicon wafer by the window.

Example 1-6

Figure 8A:
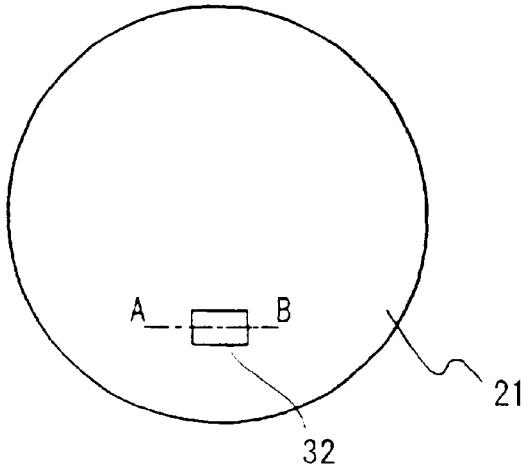
FIGS. 8A and 8B illustrate a sixth example of a polishing pad (polishing body) of the present invention.
Figure 8B:
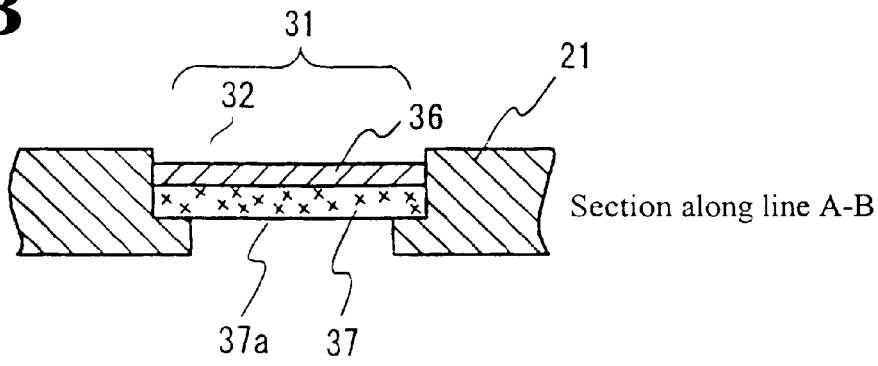

FIG. 8 is a diagram which is used to illustrate a sixth example of a polishing pad (polishing body) of the present invention. FIG. 8(*a*) is a plan view, and FIG. 8(*b*) is a sectional view of the portion indicated by line A–B in FIG. 8(*a*). In FIG. 8, 36 indicates an upper transparent material sheet, and 37 indicates a lower transparent material sheet.

In this example, a window plate 31 in which two transparent material sheets, i.e., an upper transparent material sheet 36 and a lower transparent material sheet 37, are laminated is installed in an opening part 32 formed in the polishing body (polishing pad) 21. The upper transparent material sheet 36 is a transparent material sheet located on the side of the object of polishing, and the lower transparent material sheet 37 is a transparent material sheet located on the opposite side from the object of polishing.

A transparent material such as a polyurethane, acrylic, polycarbonate, polystyrene, vinyl chloride, polyethylene terephthalate, polyester or epoxy, etc., is used as the upper transparent material sheet 36.

A transparent material such as glass, acrylic, polycarbonate, polystyrene, vinyl chloride, polyethylene terephthalate, polyester or epoxy, etc., is used as the lower transparent material sheet 37.

One or more materials selected from a set comprising epoxy resins, acrylic resins, ABC resins, vinyl chloride resins, polycarbonate resins, polyester resins, fluororesins and polyurethane resins are desirable as the material of the polishing pad (polishing body) 21.

In the present example, two sheets of transparent materials are laminated in the window; however, the number of sheets of transparent materials that are laminated may also be three or more sheets.

It is desirable that the compressive elastic modulus of the upper transparent material sheet 36, which is the transparent material sheet located on the side of the object of polishing, be smaller than the compressive elastic modulus of the lower transparent material sheet 37, which is the polishing material sheet located on the opposite side from the object of polishing. As a result, since the lower polishing material sheet 37 of the window is hard, it shows little deformation, so that there is no instability in polishing endpoint detection or instability in film thickness measurement caused by deformation of the window.

Furthermore, since the lower polishing material sheet 37 of the window is hard, an anti-reflection film can be formed on the surface 37*a* of the lower polishing material sheet 37. As a result of the formation of such an anti-reflection film, the reflection by the surface of the window of the light that passes through the window and is used for the measurement of the polished state is reduced, so that the attenuation of the intensity of this light is reduced; accordingly, there is no drop in the precision of polishing endpoint detection or the precision of film thickness measurement. It is therefore desirable that an anti-reflection film be formed on the surface 37*a* of the lower polishing material sheet 37, which is the surface on the opposite side of the window from the object of polishing.

It is desirable that the compressive elastic modulus of the upper transparent material sheet 36, which is the transparent material sheet located on the side of the object of polishing, be approximately the same as the compressive elastic modulus of the polishing body 21. The compressive elastic modulus of a common polishing body is in the range of $2.9\times10^7$Pa to $1.47\times10^9$ Pa. Accordingly, it is desirable that the compressive elastic modulus e of the upper transparent material sheet 36, which is the transparent material sheet located on the side of the object of polishing, be such that $2.9\times10^7$ Pa$\leqq$e$\leqq1.47\times10^9$ Pa. As a result, there is no scratching of the object of polishing when the window contacts the object of polishing.

It is desirable that the surface of the window plate 31 on the side of the object of polishing be recessed with respect to the surface of the polishing body 21 that is contacted by the silicon wafer 17 that constitutes the object of polishing. In this way, contact between the silicon wafer and the window plate 31 is eliminated, so that there is no scratching of the silicon wafer or scratching of the surface of the window plate 31. As a result of this elimination of scratching of the surface of the window, there is no increase in the attenuation of the light 24 emitted from the polished-state measuring device 23; accordingly, there is no drop in the precision of polishing endpoint detection or the precision of film thickness measurement.

Furthermore, the above-mentioned anti-reflection film can also be formed on the undersurfaces of the window plates 31 in Examples 1—1 through 1-5.

In Examples 1-2 through 1-6 as well, the amount of polishing agent that accumulates in the recessed area becomes excessively large in cases where the amount of recess of the surface of the window on the side of the object of polishing with respect to the surface of the polishing body exceeds 400 $\mu$m. In such cases, the polishing agent constitutes a scattering body, and causes attenuation of the light 24 that is emitted from the polished-state measuring device 23, so that the precision of polishing endpoint detection and precision of film thickness measurement drop. Accordingly, it is desirable that the amount of recess d of the portion of the window through which the light from the polished-state measuring device 23 passes (i.e., the portion used for polishing endpoint detection or film thickness measurement) be such that 0 $\mu$m<d$\leqq$400 $\mu$m. Furthermore, it is even more desirable that this amount of recess d be such that 10 $\mu$m<d$\leqq$200$\mu$m Furthermore, in all of the examples, the windows become too thin if the thickness of the window plates is less than 10% of the thickness of the polishing body, so that there is a danger that the windows will undergo deformation. If the windows undergo deformation so that the windows are optically distorted, the windows will function as lenses, etc., as a result of this distortion; as a result, the problem of unstable polishing endpoint detection and film thickness measurement arises. Accordingly, it is desirable that the above-mentioned amount of recess be no more than 90% of the thickness of the polishing body, so that the thickness of the thinnest portions of the windows is 10% of the thickness of the polishing body or greater. As a result, there is no instability in polishing endpoint detection or instability in film thickness measurement caused by distortion of the windows.

In Examples 1—1 through 1-6, the window plates 31 are directly installed in the opening parts 32 of the respective polishing bodies 21. However, it is not necessary that the windows be directly installed in the polishing body 21. For example, it would also be possible to install the windows in the platen 20 either directly or via a jig, so that at least portions of the opening parts in the polishing body 21 are closed off.

Furthermore, in Examples 1-2 through 1-6, the hole shape of the opening parts 32 formed in the respective polishing bodies 21 is a step-form shape; however, these opening parts may also be rectilinear through-holes.

Furthermore, in Examples 1—1 through 1-6, it is desirable that the transmissivity of the window plates 31 be 22% or greater. In this way, the attenuation of the intensity of the light that is used to measure the polished state via the window plates 31 is reduced, so that there is no drop in the polishing endpoint detection precision or film thickness measurement precision.

Furthermore, in Examples 1—1 through 1-6, it is desirable that the intensity of the light that [i] is emitted from the polished-state measuring device 23, [ii] passes through the window plate 31, [iii] passes through the polishing agent 19 between the window plate 31*a* nd the silicon wafer 17, [iv] is reflected by the polished surface of the silicon wafer 17, [v] again passes through the polishing agent 19 between the window plate 31*a* nd the silicon wafer 17, [vi] again passes through the window plate 31, and [vii] returns to the polished-state measuring device 23, be 1% or more of the intensity of the light 24 that is emitted form the polished-state measuring device 23. In this way, there is no drop in the intensity of the light that returns to the polished-state measuring device; accordingly, there is no drop in the polishing endpoint detection precision or film thickness measurement precision caused by the polished-state measuring device.

Furthermore, in Examples 1—1 through 1-6, dressing of the polishing body is performed; however, in cases where a non-foam material is used in the polishing body, there may be cases in which dressing is unnecessary. Even in cases where such a polishing body that does not require dressing is used, the surface of the polishing body is ground away as the object of polishing is polished. Accordingly, by using Examples 1—1 through 1-6, the frequency of replacement of the windows or polishing body can be reduced, so that the cost of polishing can be reduced.

Embodiment 1—1

Figure 9:
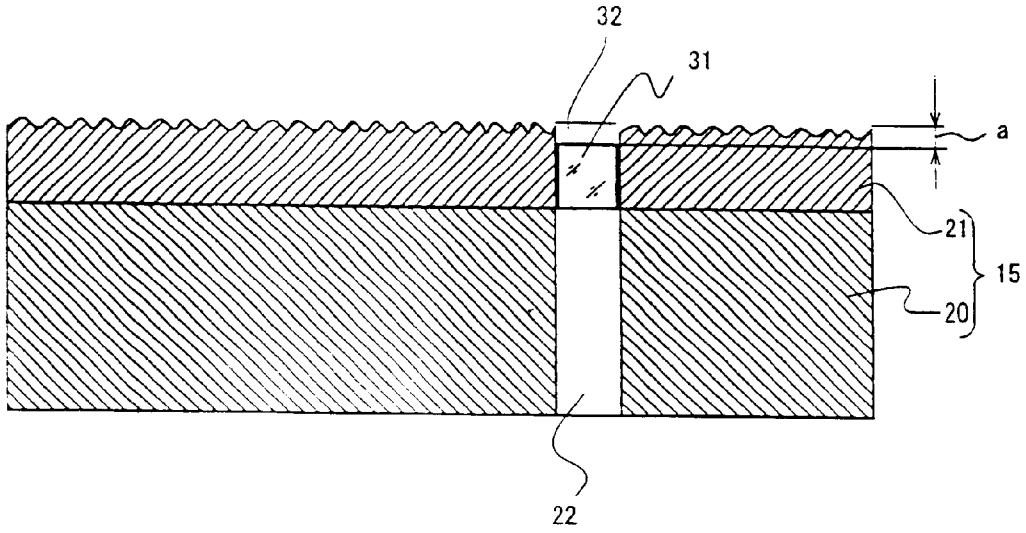
FIG. 9 illustrates a first example of a polishing pad (polishing body) that constitutes an embodiment of the present invention.

FIG. 9 is a diagram which is used to illustrate a first example of a polishing pad (polishing body) of the present invention.

In regard to the materials used, epoxy principal agents Epicote 828 and Epicote 871 (both manufactured by Yuka Shell Epoxy K. K.) and a diaminodiphenylmethane curing agent were mixed and agitated at a weight ratio of 2.6: 3.9: 1, and this mixture was caused to flow into onto an aluminum plate with a diameter of 800 mm which had a mold with hole parts as the observation window parts. The mixture was then cured by being heated for 8 hours at 150° C., thus producing a polishing pad (polishing body) 21.

Figure 10:
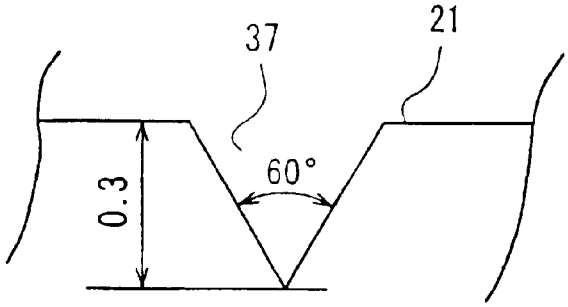
FIG. 10 illustrates the shape of the V-shaped groove of the polishing pad shown in FIG. 9.

Next, a spiral V-shaped groove (angle of V: 60°) with a pitch of 0.5 mm and a depth of 0.3 mm and lattice-form grooves with a pitch of 15 mm, a width of 2 mm and a depth of 0.5 mm were formed in the surface of the above-mentioned epoxy resin by cutting. FIG. 10 shows a sectional view of the V-shaped groove 37 (angle of V: 60°) in this polishing pad 21.

The thickness of the resin part of this polishing pad 21 was 2 mm, and the amount of compressive deformation was 2 $\mu$m in the case of a load of 10 kgf/cm$^2$ ($9.8\times10^5$ Pa).

An acrylic material was selected as the material of the window plate 31, and a hard coating with a thickness of approximately 1 $\mu$m was formed by coating this acrylic material with a hard coating liquid prepared by dispersing colloidal silica in a partial co-hydrolyzate of a universally known epoxysilane, and curing this liquid by heating. As is shown in FIG. 9, [the window plate 31 ] was inserted and fastened in the hole part of the molded polishing pad so that the hard-coated side of the window plate 31 faced toward the uppermost layer of the polishing pad, and so that the gap $\alpha$ was 100 $\mu$m in the loaded/compressed state. The transmissivity of the window plate 31 and slurry (SS25 manufactured by Cabot Co., diluted 2X) with respect to the measurement light when the opening part 32 formed above the window plate 31 was filled with the slurry was 89%.

This polishing pad 21 was bonded to the surface of a platen 20, so that a polishing member 15 was constructed. Using a polishing apparatus of the type shown in FIG. 2, a six-inch silicon wafer on which a thermal oxidation film had been formed to a thickness of 1 $\mu$m was held on the polishing head 16, and polishing was performed under the following conditions:

| |
|---|
| Polishing head rpm: 50 rpm |
| Platen rpm: 20 rpm |
| Load: 460 g/cm$^2$ (4.5 × 10$^4$ Pa) |
| Oscillation width: 30 mm |
| Oscillation rate: 15 strokes/min |
| Polishing time: 3 min |
| Slurry used: SS25 diluted 2X |
| Slurry flow rate: 200 ml/min |

Figure 11:
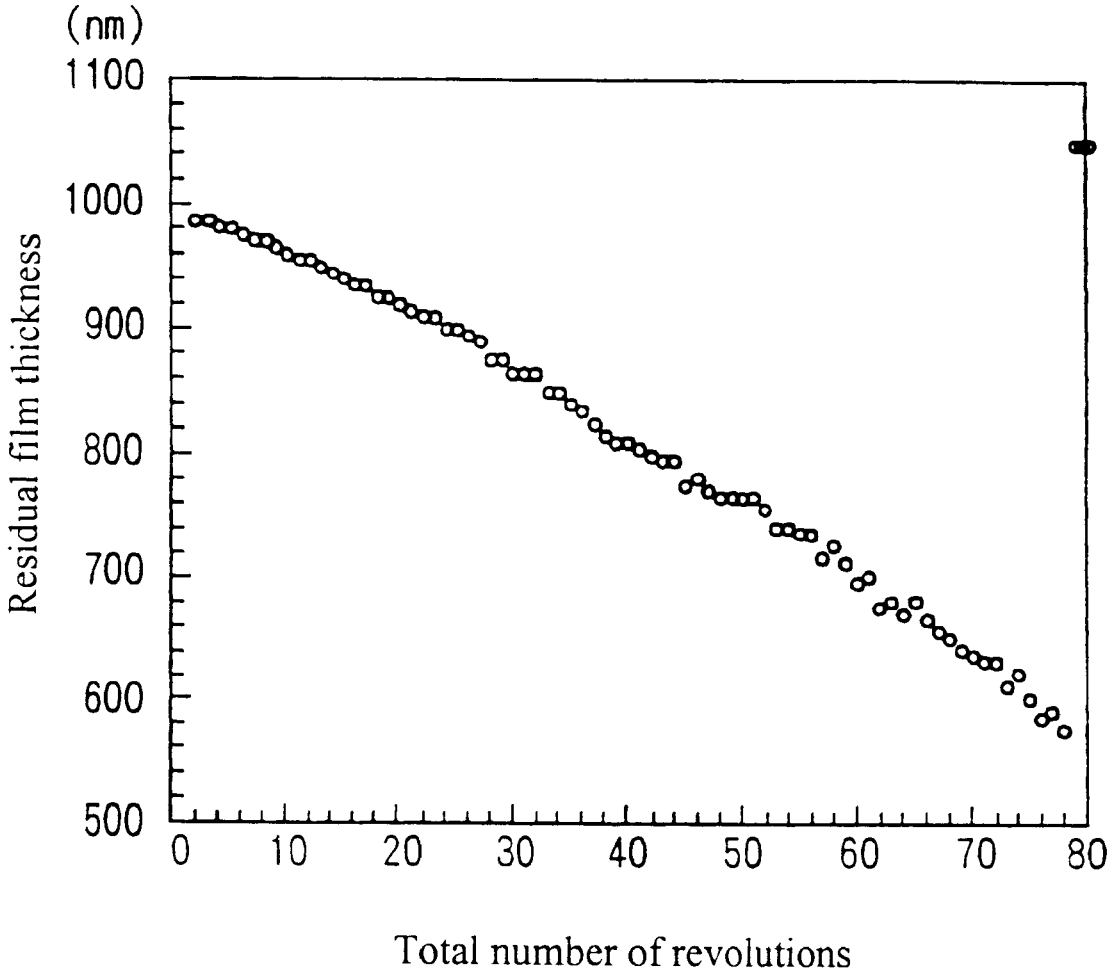
FIG. 11 shows an example of the variation in the residual film thickness observed during polishing.

During polishing, a polishing rate of 100 nm/min was observed by in-situ optical measurement of the residual film thickness via the window plate used for observation as shown in FIG. 11. The stability of this measurement was confirmed as a result of repeated measurements.

Furthermore, no deleterious effects such as non-uniformity of polishing or scratching were caused by the measurement window.

Embodiment 1-2

A polishing body of the type shown in FIG. 4 was manufactured. Here, a two-layer polishing body (hereafter referred to as "IC1000/SUBA400") in which the lower layer of the polishing body 21 comprises SUBA400 manufactured by Rodel Co., and the upper layer comprises IC1000 manufactured by Rodel Co., was used.

Window plates 31*a*, 31*b* and 31*c* comprise a polyurethane were respectively installed so that the amount of recess of the surface of the window on the side of the object of polishing from the surface of the polishing body was 0.15 mm in the case of the opening part 32*a*, 0.3 mm in the case of the opening part 32*b*, and 0.45 mm in the case of the opening part 32*c*.

This polishing body was used in the polishing apparatus shown in FIG. 2, and a six-inch silicon wafer on which a thermal oxidation film had been formed to a thickness of 1 $\mu$m was polished under the conditions shown below. The residual film thickness on the silicon wafer was measured in situ by means of the polished-state measuring device 23 using the window plate 31*a* in the opening part 32*a*.

| |
|---|
| Polishing head rpm: 50 rpm |
| Platen rpm: 50 rpm |
| Load applied to polishing head: 2.4 × 10$^4$ Pa |
| Oscillation of polishing head: none |
| Polishing time: 90 sec |

-continued

| |
|---|
| Polishing agent used: SS25 manufactured by Cabot Co., diluted 2X with ion exchange water |
| Polishing agent flow rate: 200 ml/min |

The mean polishing rate in this case was 430 nm/min. Following the completion of polishing, dressing was performed for 1 minute using a diamond grinding wheel with an abrasive grain size of #100.

Figure 12:
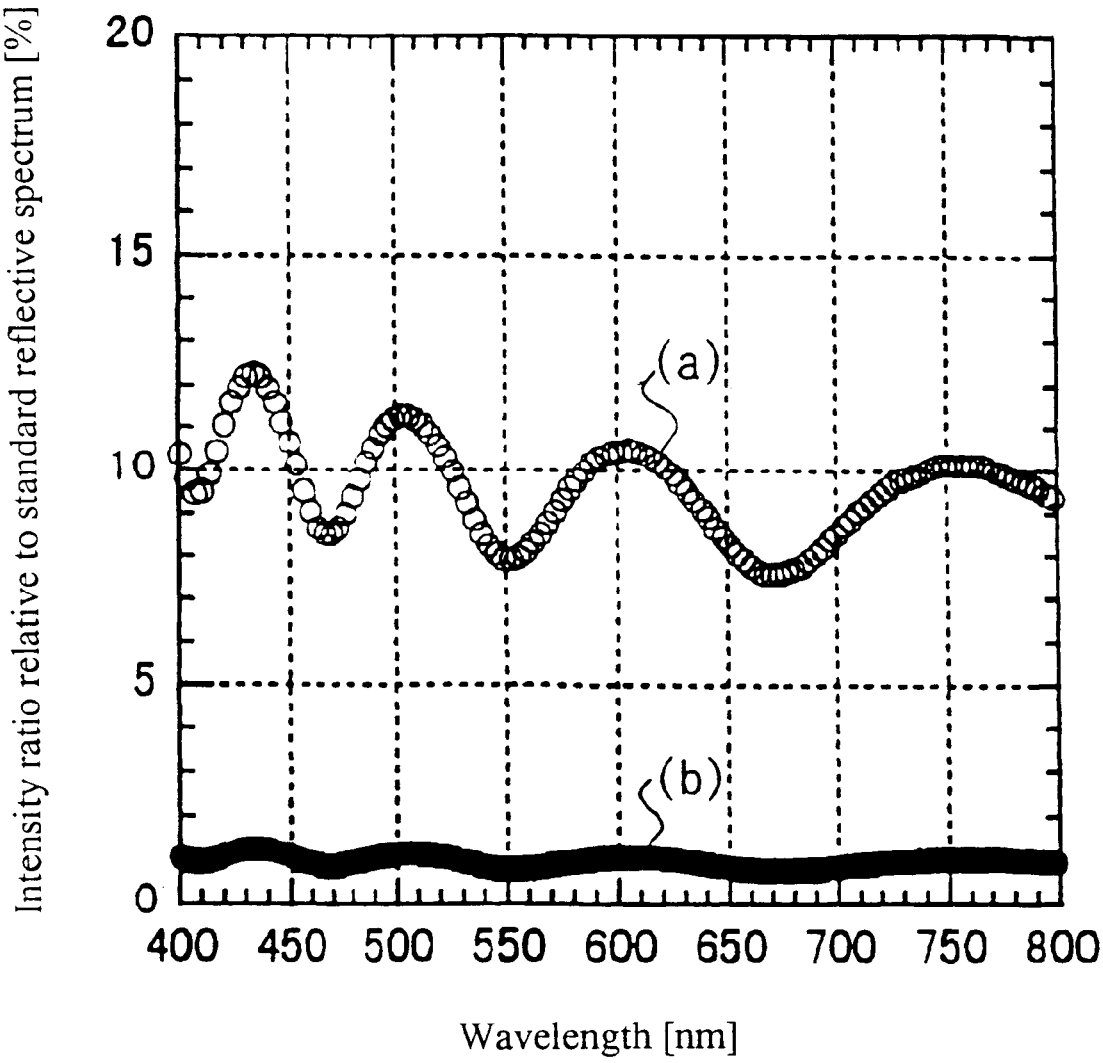
FIG. 12 shows reflective spectra from the silicon wafer surface measured in situ at certain instants during polishing.

The polishing process and dressing process were repeated, with a fresh six-inch silicon wafer on which a thermal oxidation film had been formed to a thickness of 1 $\mu$m being used each time. FIG. 12 is a graph which shows the reflective spectrum from the surface of the silicon wafer measured in situ at a certain instant during polishing. Among the curves shown in the graph of FIG. 12, curve (*a*) indicates the reflective spectrum that was obtained. In the graph shown in FIG. 12, the horizontal axis indicates wavelength, while the vertical axis indicates the intensity ratio of the measured reflective spectrum to a standard reflective spectrum obtained in a case where a silicon wafer on which an aluminum film had been formed was installed on top of the window part of the polishing body in a state in which ion exchange water was interposed instead of the polishing agent, with the reflective spectrum of the light returning to the polished-state measuring device 23 being taken as the standard reflective spectrum. In-situ measurement of the residual film thickness of the thermal oxidation film on the silicon wafer was possible by means of wavelength fitting using a simulation.

However, the window began to be scratched by dressing following the polishing of the 120$^{th}$ silicon wafer, and the reflective spectrum obtained after the polishing of the 150$^{th}$ silicon wafer was as indicated by curve (*b*) in FIG. 12, so that the probability of error being generated in the in-situ measurement became large.

Then, when in-situ measurement was performed after a switch was made to the window plate 31*b* in the opening part 32*b* in which the amount of recess in the initial state was 0.3 mm, it was found that error-free in-situ measurement was possible as before.

Furthermore, when a dressing treatment was performed following the polishing of the 260$^{th}$ silicon wafer, scratching occurred in the window plate 31*b* of the opening part 32*b*, and with the polishing of the 280$^{th}$ silicon wafer, measurement became difficult as a result of a drop in the transmissivity of the window plate 31*b*.

When in-situ measurement was again performed following a switch to the window plate 31*c* in the opening part 32*c*, in which the amount of recess in the initial state was 0.45 mm, it was found that in-situ measurement was possible as before. Finally, in the case of the window plate 31*c* in the opening part 32*c*, in-situ measurement was possible up to the polishing process and dressing process of the 450$^{th}$ silicon wafer.

Embodiment 1-3

A polishing body of the type shown in FIG. 5 was manufactured. An IC1000/SUBA400 polishing body manufactured by Rodel Co., was used as this polishing body, and an opening part 32 was formed in one place in this polishing body 21. A window plate 31 comprises a polyurethane was installed in this opening part 32. This window plate 31 was arranged so that the amount of recess of the surface of the window plate 31 on the side of the object of polishing with respect to the surface of the polishing body 21 was respectively 0.15 mm, 0.3 mm and 0.45 mm in the respective parts 33*a*, 33*b* and 33*c* of the window plate 31.

Afterward, the polishing body 21 was installed on the platen of a polishing apparatus of the type shown in FIG. 2. A six-inch silicon wafer on which a thermal oxidation film had been formed to a thickness of 1 μm was polished under the conditions shown below, and the residual film thickness on the silicon wafer was measured in situ by means of the polished-state measuring device 23 using the part 33*a* of the window plate 31.

Polishing head rpm: 50 rpm
Platen rpm: 50 rpm
Load applied to polishing head: $2.4 \times 10^4$ Pa
Oscillation of polishing head: none
Polishing time: 90 sec
Polishing agent used: SS25 manufactured by Cabot Co., diluted 2X with ion ex
Polishing agent flow rate: 200 ml/min The mean polishing rate in this case was 430 nm/min. Following the completion of polishing, dressing was performed for 1 minute using a diamond grinding wheel with an abrasive grain size of #100.

When the polishing process and dressing process were repeated using a fresh six-inch silicon wafer on which a thermal oxidation film had been formed to a thickness of 1 μm each time, the part 33*a* of the window plate 31 began to be scratched by dressing following the polishing of the $120^{th}$ silicon wafer, and with the polishing of the $150^{th}$ silicon wafer, the probability of error being generated in the in-situ measurement increased as a result of a drop in the transmissivity of the part 33*a* of the window plate 31.

Then, when in-situ measurement was performed following a switch to the part 33*b*, in which the amount of recess in the initial state was 0.3 mm, it was found that error-free in-situ measurement was possible as before.

Furthermore, when a dressing treatment was performed following the polishing of the $260^{th}$ silicon wafer, the part 33*b* of the window plate 31 began to be scratched, and with the polishing of the $280^{th}$ silicon wafer, the probability of error being generated in the in-situ measurement increased as a result of a drop in the transmissivity of the part 33*b* of the window plate 31.

When in-situ measurement was again performed following a switch to the part 33*c* of the window plate 31, in which the amount of recess in the initial state was 0.45 mm, it was found that error-free in-situ measurement was possible as before.

Finally, in the case of the part 33*c* of the window plate 31, in-situ measurement was possible up to the polishing treatment of the $450^{th}$ silicon wafer.

Embodiment 1-4

A polishing body of the type shown in FIG. 6 was manufactured. An IC1000/SUBA400 polishing body manufactured by Rodel Co., was used as this polishing body 21, and an opening part was formed in one place in this polishing body.

A window plate 31 comprises a polyurethane was installed at an inclination as shown in FIG. 6. This window plate 31 was arranged so that the amount of recess of the surface of the window plate 31 on the side of the object of polishing with respect to the surface of the polishing body 21 was a minimum of 0.1 mm (in the area of 34*a*) and a maximum of 0.5 mm (in the area of 34*d*).

Using this polishing body as the polishing body in a polishing apparatus of the type shown in FIG. 2, a six-inch silicon wafer on which a thermal oxidation film had been formed to a thickness of 1 μm was polished under the conditions shown below. The residual film thickness on the silicon wafer was measured in situ by means of the polished-state measuring device 23 using the area of 34*a* on the window plate 31.

Polishing head rpm: 50 rpm
Platen rpm: 50 rpm
Load applied to polishing head: $2.4 \times 10^4$ Pa
Oscillation of polishing head: none
Polishing time: 90 sec
Polishing agent used: SS25 manufactured by Cabot Co., diluted 2X with ion exchange water
Polishing agent flow rate: 200 ml/min The mean polishing rate in this case was 430 nm/min. Following the completion of polishing, dressing was performed for 1 minute using a diamond grinding wheel with an abrasive grain size of #100.

When the polishing process and dressing process were repeated using a fresh six-inch silicon wafer on which a thermal oxidation film had been formed to a thickness of 1 μm each time, the transmissivity in the area of 34*a* on the window plate 31 dropped as a result of dressing following the polishing of the $50^{th}$ silicon wafer, and with the polishing of the $70^{th}$ silicon wafer, the probability of error being generated in the in-situ measurement increased as a result of the drop in transmissivity.

Then, when in-situ measurement was performed following a switch to the area of 34*b*, in which a transmissivity comparable to that obtained at the initiation of polishing could be obtained, it was found that in-situ measurement was possible as before.

Furthermore, when dressing was performed following the polishing of the $110^{th}$ silicon wafer, there was a drop in the transmissivity, and with the polishing of the $140^{th}$ silicon wafer, the probability of error being generated in the in-situ measurement increased as a result of the drop in transmissivity.

When in-situ measurement was again performed following a switch to the area of 34*c* of the window plate 31, in which a transmissivity comparable to that obtained at the initiation of polishing could be obtained, [it was found that] error-free in-situ measurement was possible as before.

The operation was repeated, and in-situ measurement was ultimately possible up to the polishing treatment of the $650^{th}$ silicon wafer.

Embodiment 1-5

Figure 13:
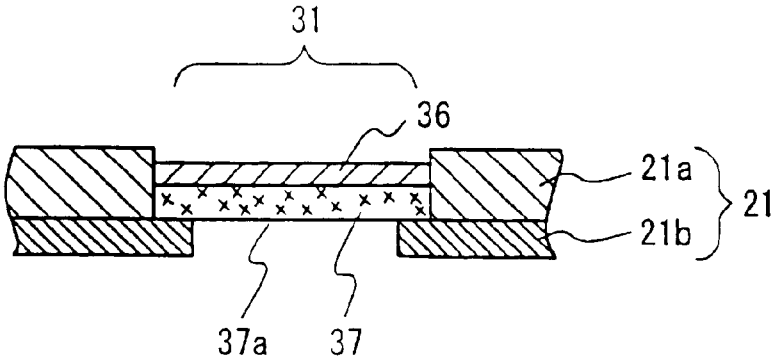
FIG. 13 is a diagram which shows the structure of an embodiment of the polishing body of the present invention which has window plates comprise a two-layer structure.

A polishing body of the type shown in FIG. 13 was manufactured. An upper transparent material sheet 36 comprises a polyurethane sheet with a size of 20 mm×50 mm and a thickness of 0.6 mm was fastened by means of a UV adhesive agent to the upper surface of a lower transparent material sheet 37 (of the same size and with a thickness of 0.5 mm) on which an anti-reflection film was formed, thus forming a two-layer window. In this case, the window 31 as a whole had a size of 20 mm×50 mm and a thickness of 1.15 mm. The anti-reflection film was formed on the surface 37*a* of the acrylic sheet constituting the lower transparent material sheet 37.

A 20 mm×50 mm opening part was formed in an IC1000 polishing body (21*a*) manufactured by Rodel Co., and a 10 mm×40 mm opening part was formed in an SUBA400 sub-polishing body (21*b*). A two-layer polishing body 21 was formed by laminating the polishing bodies so that the centers of the respective opening parts coincided. The compressive elastic modulus of the IC1000 polishing body was $7.5\times10^7$ Pa, the compressive elastic modulus of the SUBA400 sub-polishing body was $9.6\times10^6$ Pa, the compressive elastic modulus of the acrylic was $0.29\times10^{10}$ Pa, and the compressive elastic modulus of the polyurethane was $7.5\times10^7$ Pa.

Next, the window which was manufactured in advance was installed by being bonded in the opening part of the polishing body 21 using a two-sided tape with a thickness of 0.1 mm. In this case, the amount of recess of the surface of the window with respect to the surface of the polishing body was 10 $\mu$m or less.

This polishing body was attached to a polishing apparatus of the type shown in FIG. 2, and a six-inch silicon wafer on which a thermal oxidation film was formed to a thickness of 1 $\mu$m was polished under the conditions shown below. The residual film thickness of the oxidation film on the silicon wafer was measured in situ.

Figure 14:
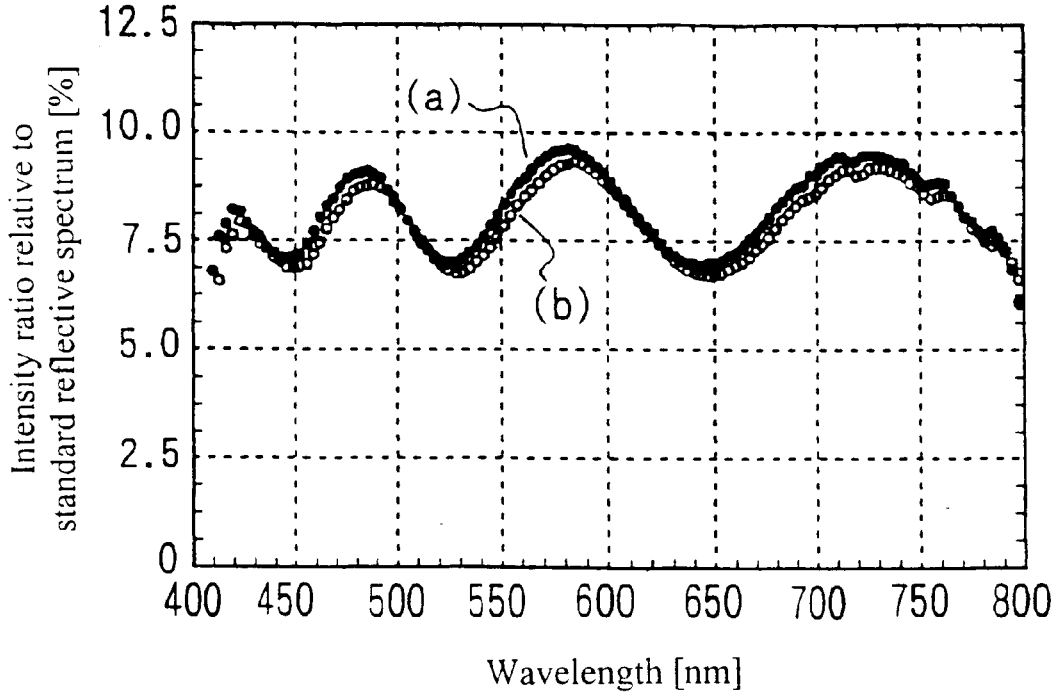
FIG. 14 shows a reflective spectrum from the silicon wafer surface measured in situ.

Polishing head rpm: 50 rpm
Polishing platen rpm: 50 rpm
Load (pressure with which the object of polishing was pressed against the polishing body): $2.4\times10^4$ Pa
Oscillation: none, Polishing time: 90 sec
Polishing agent used: SS25 manufactured by Cabot Co., diluted 2X with ion exchange water
Polishing agent flow rate: 200 ml/min The mean polishing rate in this case was 430 nm/min. In this case, there was no scratching of the silicon wafer or non-uniform polishing caused by the window. FIG. 14 is a graph of reflective spectra from the surface of the silicon wafer measured in situ. Among the curves shown in the graph of FIG. 14, curve (*a*) is the reflective spectrum of the present embodiment.

In the graph shown in FIG. 14, the horizontal axis indicates wavelength, while the vertical axis indicates the intensity ratio of the measured reflective spectrum to a standard reflective spectrum obtained in a case where a silicon wafer on which an aluminum film had been formed was installed on top of the window part of the polishing body in a state in which ion exchange water was interposed instead of the polishing agent, with the reflective spectrum of the light returning to the polished-state measuring device 23 being taken as the standard reflective spectrum. Measurement of the polished state (i.e., the residual film thickness of the thermal oxidation film on the silicon wafer) was possible by means of wavelength fitting using a simulation.

Embodiment 1-6

A polishing body was manufactured by a process of the type shown in FIG. 15.

A quartz glass substrate 41 with a size of 20 mm×50 mm and a thickness of 1 mm, on which an anti-reflection film 42 was formed, was prepared (FIG. 15(*a*)). A heat-resistant tape 43 was wrapped around the periphery of this quartz glass substrate 41, thus forming a vessel with a quartz glass bottom surface (FIG. 15(*b*)). A resin 44 formed by mixing Epicote 828 and Epicote 871 (manufactured by Yuka Shell Epoxy K. K.) at a weight ratio of 4: 6, and mixing a dissolving p,p'-methylenedianiline (as a curing agent) with this mixture in an amount equivalent to the epoxy, was poured into the vessel and cured by heating (FIG. 15(*c*)). Next, after the epoxy resin 48 was cut away parallel to the quartz glass by means of a bit 49, etc., (FIG. 15 (*d*)), the epoxy resin 48 was worked to a mirror surface by polishing, thus producing a window 45 comprises the anti-reflection film/quartz glass/epoxy resin (in that order from the bottom) (FIG. 15(*e*)). In this case, the thickness of the window was 1.6 mm.

An aluminum plate 47 with an opening part 46 was prepared (FIG. 15(*f*)), and a heat-resistant tape 43 was bonded to the opening part and periphery of this aluminum plate 47 (FIG. 15(*g*)). An epoxy resin 44 of the same composition as that used in the manufacture of the window 45 was then poured in to produce a resin layer with a thickness of 4 mm, and this resin was cured by heating (FIG. 15(*h*)). Afterward, in order to form the worked epoxy resin 50 into a polishing body, the heat-resistant tape on the periphery was removed, and a specified groove pattern was formed in the surface of the polishing body by mechanical cutting (FIG. 15 (*i*)).

Next, a step-form hole was formed in the opening part with the size adjusted so that the surface of the above-mentioned window would be at the same height as the surface of the polishing body (FIG. 15(*j*)), and the window was fastened in place by means of a two-sided tape (FIG. 15(*k*)). The amount of recess of the surface of the window with respect to the surface of the polishing body in this case was less than 10 $\mu$m, so that the surface of the window and the surface of the polishing body constituted more or less the same surface.

In this embodiment, an aluminum plate with an opening part 46 was used as the aluminum plate; however, it would also be possible to use an aluminum plate that does not have an opening part, and to form an opening part in the aluminum plate at the same time that an opening part is formed in the polishing body in the process shown in FIG. 15(*j*).

In this embodiment, quartz glass was used as the lower transparent material, and an epoxy resin was used as the upper transparent material. The compressive elastic modulus of the epoxy resin was $1.47\times10^9$ Pa, and the compressive elastic modulus of the quartz glass was $7.31\times10^{10}$ Pa.

The polishing body thus manufactured was attached to a polishing apparatus of the type shown in FIG. 2, and a six-inch silicon wafer on which a thermal oxidation film was formed to a thickness of 1 $\mu$m was polished under the conditions shown below. The residual film thickness of the oxidation film on the silicon wafer was measured in situ.

Polishing head rpm: 50 rpm
Polishing platen rpm: 50 rpm
Load (pressure with which the object of polishing was pressed against the polishing body): $2.4\times10^4$ Pa
Oscillation: none
Polishing time: 90 sec
Polishing agent used: SS25 manufactured by Cabot Co., diluted 2X with ion exchange water
Polishing agent flow rate: 200 ml/min The mean polishing rate in this case was 210 nm/min. Furthermore, there was no scratching of the silicon wafer or non-uniform polishing caused by the window. Moreover, the reflective spectrum from the surface of the silicon wafer obtained by in-situ measurement is curve (*b*) in FIG. 14. Measurement of the polished state (i.e., the residual film thickness of the thermal oxidation film on the silicon wafer) was possible by means of wavelength fitting using a simulation.

Comparative Example 1-1

An IC1000 /SUBA400 polishing body manufactured by Rodel Co., was used as a polishing body; an opening part was formed in one place in this polishing body. A window comprising a polyurethane was installed in the opening part of the polishing body so that the amount of recess of the surface of the window on the side of the object of polishing from the surface of the polishing body was 10 $\mu$m or less.

This polishing body was installed in a polishing apparatus of the type shown in FIG. 2, and a six-inch silicon wafer on which a thermal oxidation film was formed to a thickness of 1 $\mu$m was polished under the conditions shown below. The residual film thickness on the silicon wafer was measured in situ.

Polishing head rpm: 50 rpm
Platen rpm: 50 rpm
Load applied to polishing head: $2.4 \times 10^4$ Pa
Oscillation of polishing head: none
Polishing time: 90 sec
Polishing agent used: SS25 manufactured by Cabot Co., diluted 2X with ion exchange water
Polishing agent flow rate: 200 ml/min The mean polishing rate in this case was 430 nm/min.

When dressing was performed for 1 minute by means of a diamond grinding wheel with an abrasive grain size of #100 following the completion of polishing, the surface of the window on the side of the object of polishing was scratched, and became opaque. The total amount of transmitted light passing through the window in this case was 1% or less of the total amount of transmitted light prior to dressing (i.e., when the surface of the window on the side of the object of polishing was not scratched).

A second silicon wafer was polished under the same polishing conditions as those described above; however, in-situ measurement of the residual film thickness on the silicon wafer was not possible.

Comparative Example 1-2

An IC1000/SUBA400 polishing body manufactured by Rodel Co., was used as a polishing body; an opening part was formed in one place in this polishing body. A window comprising an acrylic resin was installed in the opening part of the polishing body so that the amount of recess of the surface of the window on the side of the object of polishing from the surface of the polishing body was 0.1 mm.

This polishing body was installed in a polishing apparatus of the type shown in FIG. 2, and 150 six-inch silicon wafers on which a thermal oxidation film was formed to a thickness of 1 $\mu$m were continuously polished under the conditions shown below. The residual film thickness on the silicon wafers was measured in situ.

Polishing head rpm: 50 rpm
Platen rpm: 50 rpm
Load applied to polishing head: $2.4 \times 10^4$ Pa
Oscillation of polishing head: none -continued Polishing time: 90 sec
Polishing agent used: SS25 manufactured by Cabot Co., diluted 2X with ion exchange water
Polishing agent flow rate: 200 ml/min Dressing conditions: 1 minute for each silicon wafer polished, using a diamond grinding wheel with an abrasive grain size of #100.

As a result, scratching of the window occurred after 17 silicon wafers were polished. When polishing was continued, the amount of light reflected from the silicon wafer became attenuated after 53 wafers were polished, so that in-situ measurement became difficult. When the window was checked, it was found that the window had come to resemble mica glass as a result of scratches caused by dressing. Measurements of the thickness of the polishing body before and after polishing indicated that the polishing body had suffered 0.05 mm of wear as a result of polishing and dressing.

Comparative Example 1-3

An acrylic window with a size of 20 mm×50 mm and a thickness of 2 mm on which an anti-reflection film was formed was fastened in the same manner as in Embodiment 1-6 in the opening part of a polishing body manufactured in the same manner as in Embodiment 1-6, so that the surface of the window and the surface of the polishing body were at the same height. The recess of the surface of the window with respect to the surface of the polishing body in this case was 10 $\mu$m or less.

This polishing body was attached to a polishing apparatus of the type shown in FIG. 2, and a six-inch silicon wafer on which a thermal oxidation film was formed to a thickness of 1 $\mu$m was polished under the conditions shown below. The residual film thickness of the oxidation film on the silicon wafer was measured in situ.

Polishing head rpm: 50 rpm
Polishing platen rpm: 50 rpm
Load (pressure with which the object of polishing was pressed against the polishing body): $2.4 \times 10^4$ Pa
Oscillation: none
Polishing time: 90 sec
Polishing agent used: SS25 manufactured by Cabot Co., diluted 2X with ion exchange water
Polishing agent flow rate: 200 ml/min As in Embodiments 1-5 and 1-6, a reflective spectrum from the surface of the silicon wafer was obtained by measurement in situ, and it was possible to measure the polished state (i.e., the residual film thickness of the thermal oxidation film on the surface of the silicon wafer) in situ. However, the silicon wafer was scratched by polishing.

Comparative Example 1-4

A polyurethane window with a size of 20 mm×50 mm and a thickness of 2 mm was fastened in the same manner as in Embodiment 1–6 in the opening part of a polishing body manufactured in the same manner as in Embodiment 1-6, so that the surface of the window and the surface of the polishing body were at the same height.

This polishing body was attached to a polishing apparatus of the type shown in FIG. 2, and a six-inch silicon wafer on which a thermal oxidation film was formed to a thickness of 1 μm was polished under the conditions shown below. The residual film thickness of the oxidation film on the silicon wafer was measured in situ using the opening part.

| |
|---|
| Polishing head rpm: 50 rpm |
| Polishing platen rpm: 50 rpm |
| Load (pressure with which the object of polishing was pressed against the polishing body): $2.4 \times 10^4$ Pa |
| Oscillation: none |
| Polishing time: 90 sec |
| Polishing agent used: SS25 manufactured by Cabot Co., diluted 2X with ion exchange water |
| Polishing agent flow rate: 200 ml/min |

Figure 16:
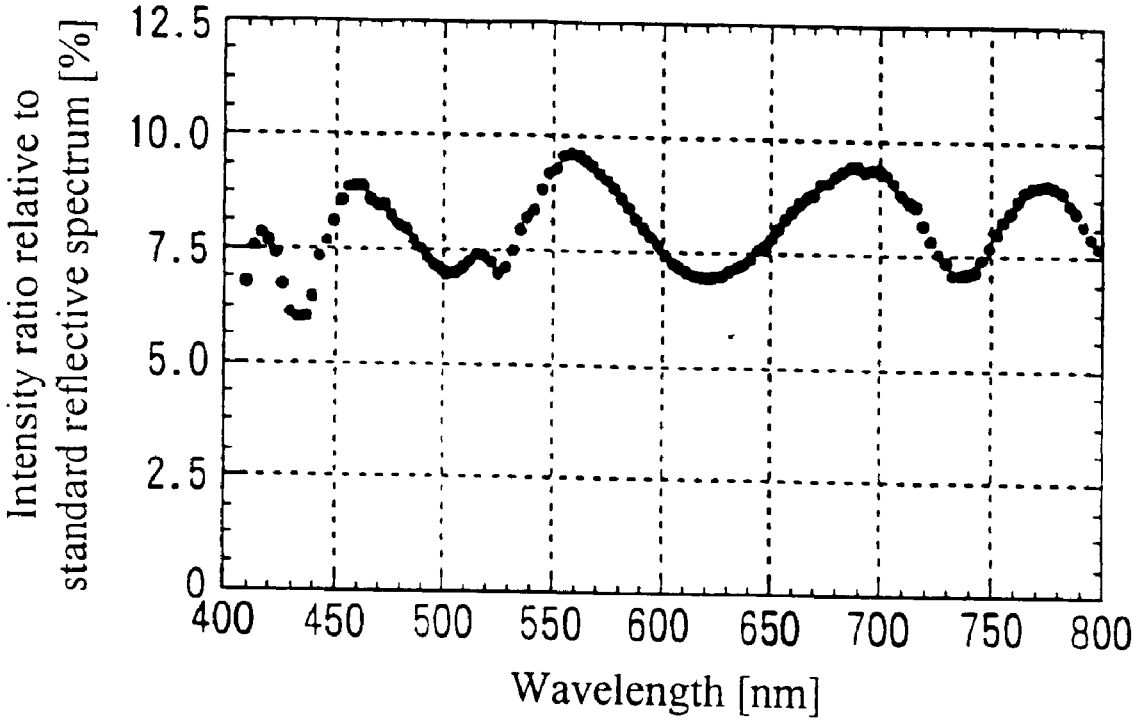
FIG. 16 shows a reflective spectrum observed during polishing.

In this case, there was no scratching of the silicon wafer or non-uniform polishing caused by the window. FIG. 16 is a graph of the reflective spectrum obtained in this case. As a result of deformation of the polyurethane window, the shape of the measured reflective spectrum was distorted, so that this spectrum did not agree with the measurement simulation; accordingly, film thickness measurement was difficult.

Example 1-7

A method for adjusting the gap between the outermost surface of the polishing pad 21 (i.e., the surface that contacts the object of polishing) and the surface of the window plate 31 on the side of the outermost surface of the polishing pad 21 in the above-mentioned polishing apparatus shown in FIG. 2, this method being one example of the present invention, will be described. A device which measures the polished film thickness or the polishing endpoint from the reflective spectroscopic characteristics (reflective spectrum) is used as the polished-state measuring device 23. The reflective spectrum measured by the polished-state measuring device 23 is compared with a reference spectrum obtained by simulation, etc., in the signal processing device of the polished-state measuring device 23, so that the polished film thickness or polishing endpoint is measured.

In cases where the gap between the outermost surface of the polishing body 21 and the surface of the window plate 31 on the side of the outermost surface of the polishing body 21 is too large, the loss of light caused by the polishing agent that is present in the recessed part formed in the polishing body 21 above the window plate 31 becomes excessive. As a result, only a very weak signal can be obtained in the polished-state measuring device 23, so that the polished film thickness or polishing endpoint cannot be measured in a favorable manner. On the other hand, in cases where the gap between the outermost surface of the polishing body 21 and the surface of the window plate 31 on the side of the outermost surface of the polishing body 21 is too small, a signal created by the interference of the layer of polishing agent that is present in the above-mentioned recessed part is added to the signal of the polished-state measuring device 23, so that the polished film thickness or polishing endpoint cannot be measured in a favorable manner.

In the present example, however, the gap between the outermost surface of the polishing body 21 (i.e., the surface that contacts the object of polishing) and the surface of the window plate 31 on the side of this outermost surface is adjusted while monitoring the signal measured by the polished-state measuring device 23 so that a signal with a strength that allows favorable measurement of the polished film thickness or polishing endpoint can be measured by the polished-state measuring device 23. Accordingly, in the polishing process, the polished-state measuring device 23 can measure the polished film thickness or polishing endpoint in a favorable manner.

Example 1-8

Next, a method for measuring the polished film thickness or polishing endpoint which constitutes an example of the present invention will be described with reference to FIG. 2. Here, a device which measures the polished film thickness or polishing endpoint from the reflective spectroscopic characteristics (reflective spectrum) is used as the polished-state measuring device 23.

There may be instances in which the thickness of the layer of polishing agent between the window plate 31 and object of polishing is not constant during polishing, so that an inappropriate signal is obtained in the measurement of the polished film thickness or polishing endpoint. The term "inappropriate signal" refers to (for example) an extremely weak signal that is obtained in cases where the loss caused by the polishing agent is excessive as described above, or a signal which includes a signal caused by interference of the layer of polishing agent that is present in the recessed part formed on top of the window plate 31.

In the present example, this problem is dealt with as follows: specifically, inappropriate signals obtained during adjustment by the adjustment method constituting the example of the present invention, etc., are stored in a memory device (not shown in the figures) as signals measured beforehand; then, during polishing, the present working configuration includes a stage in which the signal measured by the polished-state measuring device 23 is compared with the signals stored in the memory device, and if these signals are equal, the signal measured by the polished-state measuring device 23 is not used in polished film thickness measurement or polishing endpoint detection. As a result, even in cases where the thickness of the layer of polishing agent between the window and the object of polishing is not constant, so that measurement is unstable, there is no erroneous measurement in the measurement of the polished film thickness or polishing endpoint.

Example 1-9

Figure 17:
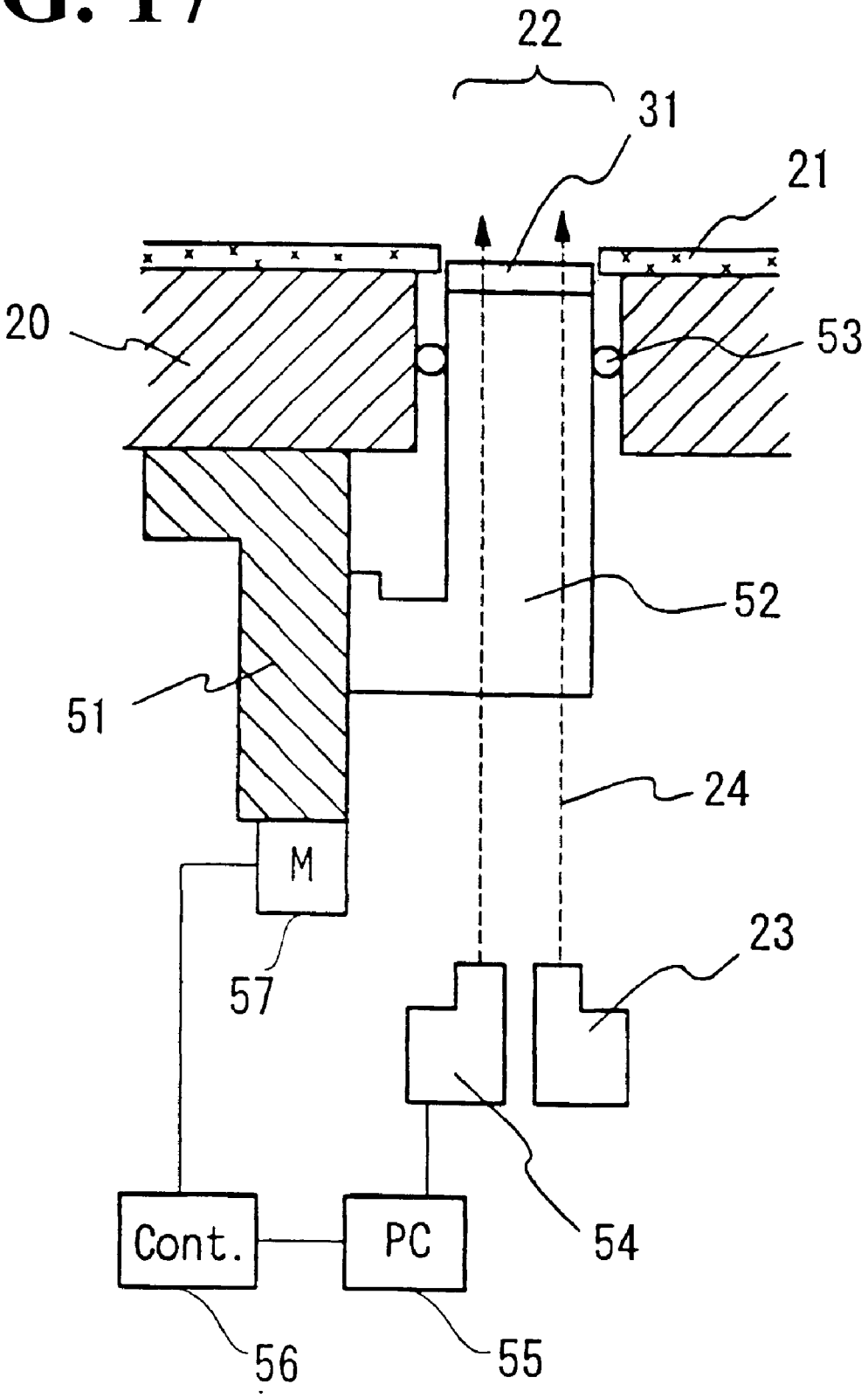
FIG. 17 is a sectional view of the area in the vicinity of one of the opening parts in the platen of a polishing apparatus of the present invention.

FIG. 17 is a sectional view of the area in the vicinity of the opening part in the platen of a polishing apparatus constituting an example of the present invention. In FIG. 17, 51 indicates a moving device comprising an electrically operated stage, 52 indicates a window supporting stand, 53 indicates an 0-ring, 54 indicates a gap sensor, 55 indicates a computer, 56 indicates a stage controller, and 57 indicates a motor.

A window supporting stand 52 which supports the window plate 31 is attached to the moving device 51, and a movable window formed by installing the window plate 31 on the upper end of the window supporting stand 52 is installed in the opening part 22 of the platen 20. Thus, the window plate 31 is installed in the platen 20 via the window supporting stand 52 and the moving device 51. A piezoelectric stage, etc., may also be used as the moving device 51 instead of an electrically operated stage. The window supporting stand 52 is a pipe-form part, and the hollow part of this pipe forms a light path for polishing endpoint detection or film thickness measurement, etc. In order to prevent invasion by the polishing agent, the gap between the opening part 22 in the platen 20 and the window supporting stand 52 is sealed by means of grease (not shown in the figures) or an O-ring 53, or both.

The window supporting stand 52 and window plate 31 can be moved in the vertical direction in FIG. 17 by means of the moving device 51, so that the position of the surface of the window plate 31 on the side of the object of polishing can be moved.

A device 23 which observes the state of the polished surface, and a gap sensor 54 which senses the gap between the surface of the window plate 31 and the polished surface of the silicon wafer constituting the object of polishing, are installed beneath the platen 20. The gap between the surface of the window plate 31 on the side of the object of polishing and the polished surface of the object of polishing is the same as the amount of recess of the surface of the window plate 31 on the side of the object of polishing with respect to the surface of the polishing body 21. Polishing endpoint detection or film thickness measurement is performed by the polished-state measuring device 23. A sensor utilizing the auto-focus principle, a sensor utilizing the interference principle, or a sensor which emits light, receives the reflected light and outputs a control signal so that the amount of light received remains constant, etc., may be used as the gap sensor 54.

The motor 57 of the electrically operated stage is driven via the computer 55 (which constitutes a control device) and stage controller 56 in accordance with the measurement results of the gap sensor 54, so that the gap between the surface of the window plate 31 on the side of the object of polishing and the polished surface of the silicon wafer (not shown in the figures) constituting the object of polishing is controlled. Furthermore, the control of the gap between the surface of the window plate 31 and the polished surface of the silicon wafer (not shown in the figures) according to the signal from the gap sensor 54 is set and controlled by the computer 55 so that the above-mentioned gap always remains constant.

Each time the polishing of one silicon wafer is completed, dressing is performed. During dressing as well, the position of the surface of the window plate 31 is controlled so that this position is fixed in the position to which the surface was controlled during the above-mentioned polishing. Following dressing, the silicon wafer that is to be polished next is attached to the polishing head 16, and polishing is performed. Thus, the polishing process and dressing process are alternately repeated.

Furthermore, in this example, the position of the window plate 31 is controlled using a gap sensor 54 that senses the gap between the surface of the window plate 31 on the side of the object of polishing and the polished surface of the silicon wafer that constitutes the object of polishing; however, it would also be possible to install a device that senses the state of wear of the polishing body 21 instead of the above-mentioned gap sensor 54. In such a case, the moving device 51 may be controlled so that the surface of the window plate 31 on the side of the object of polishing is moved downward in FIG. 17 by an amount corresponding the amount of wear of the polishing body 21.

A contact needle type displacement gauge or an optical displacement gauge, etc., can be used as a device that senses the state of wear of the polishing body 21. Furthermore, control of the position of the window plate 31 may also be performed using both a gap sensor 54 and a device that senses the state of wear of the polishing body.

Thus, in the polishing apparatus of the present example, the position of the surface of the window plate 31 on the side of the object of polishing is controlled by the moving device 51, so that the surface of the window plate 31 on the side of the object of polishing is recessed with respect to the surface of the polishing body 21, thus maintaining a constant gap between the surface of the window plate 31 and the polished surface of the silicon wafer that constitutes the object of polishing, and this state is also maintained during dressing. Accordingly, since the surface of the window on the side of the object of polishing is not scratched by dressing, polishing endpoint detection or film thickness measurement can be accomplished at all times. As a result, the same polishing body can be used in polishing for a longer period of time than is possible in the case of conventional polishing bodies, so that the frequency of replacement of the polishing body or window is reduced, thus making it possible to reduce the cost of polishing.

Furthermore, in the polishing apparatus of the present example, the control of the gap between the surface of the window plate 31 and the polished surface of the silicon wafer is set and controlled by a computer 55 so that the gap is always maintained at a constant value; however, in a method that differs from this control method, it would also be possible to control the gap between the surface of the window and the polished surface of the silicon wafer by using the computer 55 to predict the amount of wear of the polishing body from the polishing conditions, polishing time, dressing conditions and dressing time.

In the descriptions of the respective examples given above, it was assumed that dressing was performed each time that the polishing of a single silicon wafer is completed; however, it goes without saying that these examples could also be used in cases where dressing of the polishing body is performed each time that the polishing of an appropriate number of silicon wafers comprising two or more silicon wafers is completed.

Example 1-10

The basic construction of the polishing apparatus of the present example is the same as the construction in Example 1–9 (FIG. 17); however, a position sensor is further installed on the platen 20. The position sensor that is used is a sensor that outputs a signal only when a silicon wafer is positioned above the opening part 22 in the platen (or only when no silicon wafer is positioned above the opening part in the platen), and the signal from this position sensor is input into the computer 55. Furthermore, dynamic control that is synchronized with the rotation of the platen 20 is performed, thus causing the window plate 31 to be moved, so that when a silicon wafer is present in a position other than a position above the opening part 22, the amount of recess of the surface of the window plate 31 on the side of the object of polishing with respect to the surface of the polishing body 21 is increased to a value that is greater than the gap that is present between the surface of the window plate 31 and the silicon wafer when a silicon wafer is positioned above the opening part 22.

Thus, since the amount of recess of the window is controlled so that this amount of recess is small only when the polishing endpoint or film thickness is being measured during polishing, and is large at all other times, there is no need to perform dressing of the polishing body 21 between polishing operations; instead, a diamond grinding wheel, etc., used for dressing can be disposed on the polishing body 21 together with the polishing head, and dressing can be performed simultaneously (i.e., in situ) with polishing.

Thus, in the polishing apparatus of the present example, as a result of the position of the surface of the window plate 31 on the side of the object of polishing being controlled by the moving device 51, the amount of recess of the surface of the window plate 31 on the side of the object of polishing with respect to the surface of the polishing body 21 is increased when a diamond grinding wheel used for dressing passes over the opening part of the polishing body 21; accordingly, even if dressing is performed while the object of polishing is being polished, this dressing will cause no scratching of the surface of the window on the side of the object of polishing, so that polishing endpoint detection or film thickness measurement can be performed at all times.

As a result, the same polishing body can be used in polishing for a longer period of time than is possible in the case of conventional polishing bodies, so that the frequency of replacement of the polishing body or window is reduced; furthermore, since there is no need to take extra time in order to perform dressing, the overall time required for the polishing of a plurality of objects of polishing is shortened. Accordingly, the cost of polishing can be reduced.

Thus, in Examples 1-9 and 1-10 as well, it is desirable (for the reasons described above) that the position of the window be controlled so that the amount of recess d of the surface of the window on the side of the object of polishing with respect to the surface of the polishing body in the position where the measurement light passes through is such that $0\ \mu m < \leqq 400\ \mu m$.

Furthermore, in these examples as well, it is desirable that a material of the type described above be used as the window material.

Example 1-11

Figure 18A:
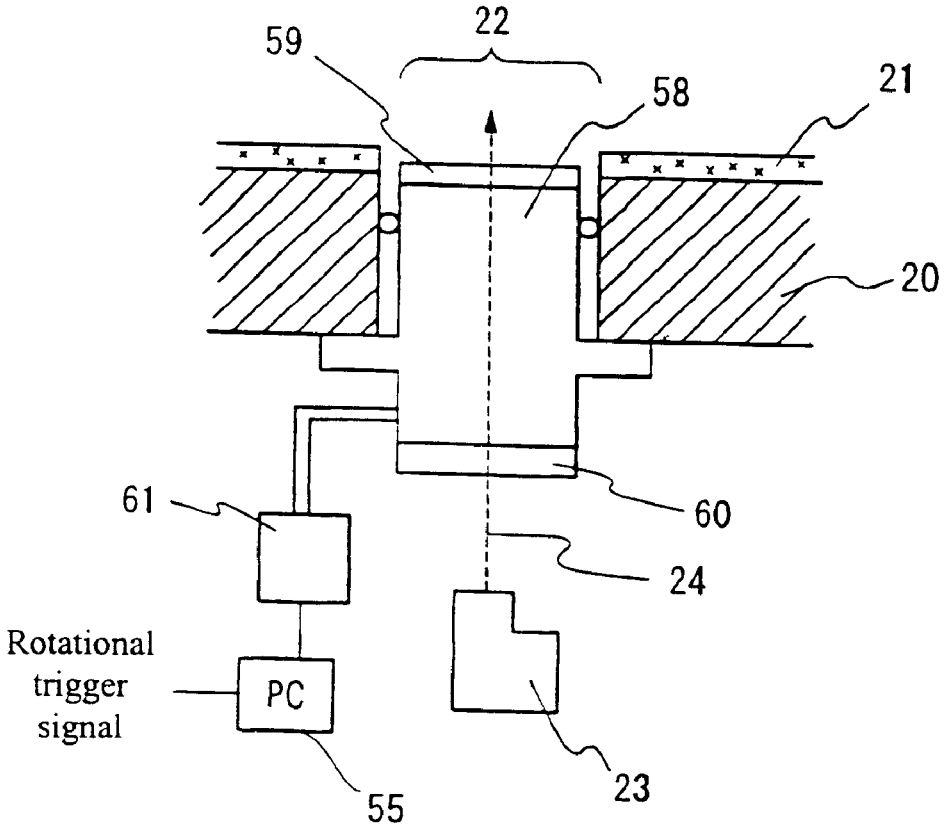
FIGS. 18A and 18B show an outline of the area in the vicinity of the polishing body of a polishing apparatus.
Figure 18B:
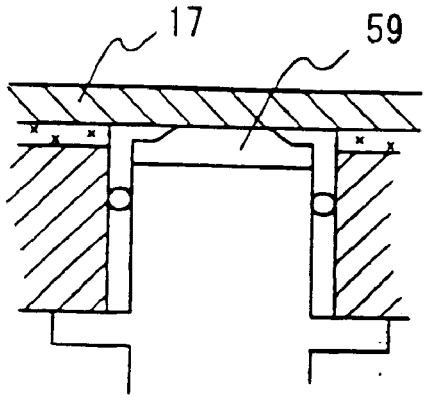

FIG. 18 shows a schematic outline of the area in the vicinity of the polishing body of the polishing apparatus of the present example. FIG. 18(*a*) is a sectional view of the area in the vicinity of the opening part, and FIG. 18(*b*) is a sectional view which shows the conditions in the vicinity of the opening part when the object of polishing has arrived at a point above the opening part. In FIG. 18, 58 indicates a window fastening tube, 59 indicates a transparent rubber window, 60 indicates a glass window, and 61 indicates an air pressure control device.

A transparent rubber window 59 is attached to the upper end of the window fastening tube 58, and a glass window 60 is attached to the lower end. Furthermore, an air pressure control device 61 which is used to pressurize or depressurize the interior of the window fastening tube 58 is connected to the window fastening tube 58. A polishing body 21 in which an opening part that conforms to the size of the transparent rubber window 59 is formed is installed by being bonded to the platen 20. The transparent rubber window 59 is installed in the platen 20 via the window fastening tube 58, which functions as a moving device.

When the pressure inside the window fastening tube 58 is a reduced pressure (ordinary pressure), the window fastening tube 58 is disposed in the opening part 22 of the platen 20 in a position which is such that the surface of the transparent rubber window 59 on the side of the object of polishing is recessed with respect to the surface of the polishing body 21. Then, when the pressure inside the window fastening tube 58 is increased by the air pressure control device 61, the transparent rubber window 59 attached to the upper end of the window fastening tube 58 expands upward.

When the transparent rubber window 59 expands upward, this window tends to protrude slightly upward from the surface of the polishing body 21; however, when a silicon wafer 17 is present above the opening part 22, the surface of the transparent rubber window 59 on the side of the object of polishing adheres tightly to the polished surface of the silicon wafer 17 as shown in FIG. 18(*b*).

Thus, by adjusting the pressure inside the window fastening tube 58 by means of the air pressure control device 61, it is possible to cause expansion of the transparent rubber window 59, so that this device functions as a moving device that moves the surface of the transparent rubber window 59 on the side of the object of polishing upward and downward in FIG. 18.

A position sensor is installed on the platen 20; the position sensor used in this case is a sensor that outputs a signal only when a silicon wafer 17 is positioned above the opening part 22 in the platen (or only when no silicon wafer is positioned above the opening part in the platen), and the signal from this position sensor is input into the computer 55. Furthermore, dynamic control that is synchronized with the rotation of the platen 20 is performed so that when a silicon wafer 17 is positioned above the opening part 22, the pressure inside the window fastening tube 58 is increased, and so that when such a wafer is positioned in any other position, the pressure inside the window fastening tube 58 is reduced (to ordinary pressure). As a result of this control, the surface of the transparent rubber window 59 on the side of the object of polishing contacts the surface of the silicon wafer 17 when such a silicon wafer 17 is present above the opening part 22, and the surface of the transparent rubber window 59 on the side of the object of polishing is recessed with respect to the surface of the polishing body 21 when such a wafer is present in any other position.

A polished-state measuring device 23 is installed beneath the platen 20, and polishing endpoint detection and film thickness measurement are performed in the same manner as in Example 1-9.

As a result of the position of the surface of the transparent rubber window 59 being controlled as described above, there is no need to perform dressing of the polishing body 21 between polishing operations; instead, in-situ dressing is possible.

Furthermore, this example is arranged so that the surface of the transparent rubber window 59 on the side of the object of polishing contacts the silicon wafer 17 during polishing endpoint detection or film thickness measurement; however, such contact is not absolutely necessary.

In the present example as well, for the reasons described above, it is desirable that the amount of recess d of the portion of the transparent rubber window 59 through which the light from the polished-state measuring device 23 passes (i.e., the portion that is used for polishing endpoint detection and film thickness measurement) be such that $0\ \mu m < d \leqq 400\ \mu m$ during measurement, and an amount of recess which is such that $10\ \mu m\ d \leqq 200\ \mu m$ is especially desirable.

Thus, in the polishing apparatus of the present example, the position of the surface of the window on the side of the object of polishing is controlled by controlling the pressure inside the window fastening tube 58, so that the amount of recess of the surface of the window on the side of the object of polishing with respect to the surface of the polishing body is increased when the diamond grinding wheel used for dressing passes over the opening part of the polishing body. Accordingly, even if dressing is performed while the object of polishing is being polished, this dressing causes no scratching of the surface of the window on the side of the object of polishing, so that polishing endpoint detection or film thickness measurement can be accomplished at all times. As a result, the same polishing body can be used in polishing for a longer period of time than is possible in the case of conventional polishing bodies, so that the frequency of replacement of the polishing body or window is reduced; furthermore, since there is no need to take extra time in order to perform dressing, the overall time required for the polishing of a large number of objects of polishing is shortened. Accordingly, the cost of polishing can be reduced.

In all of the examples described above, it is desirable to use a device that detects the polishing endpoint and measures the film thickness from the reflective spectroscopic characteristics (i.e., the reflective spectrum) as the polished-state measuring device 23 that is installed beneath the platen 20. Calculation of the film thickness or detection of the polishing endpoint is accomplished by comparing the reflective spectrum measured by the polished-state measuring device 23 with a reference spectrum obtained by simulation, etc., in a computer (not shown in the figures). Furthermore, it would also be possible to use a device that detects the polishing endpoint or measures the film thickness from variations in the reflectivity at a specified wavelength, or a device that detects the polishing endpoint or measures the film thickness by imaging the polished surface with a CCD camera, etc., and subjecting the image thus acquired to image processing, etc., as the polished-state measuring device 23 instead of the device that detects the polishing endpoint and measures the film thickness from the reflective spectroscopic characteristics (reflective spectrum).

Embodiment 1-7

A polishing apparatus with a construction such as that shown in FIG. 17 was manufactured. A window supporting stand 52 was attached to a moving device (electrically operated stage) 51 that had a stroke of 10 mm, and an acrylic window plate 31 was installed on the upper end of this window supporting stand 52.

A polished-state measuring device 23 and a gap sensor 54 were installed beneath the platen 20. A sensor utilizing an auto-focus mechanism was used as the gap sensor 54.

Next, a polishing body 21 (IC1000/SUBA400 manufactured by Rodel Co.) in which an opening part conforming to the size of the window plate 31 was formed was installed on the platen 20. The control of the gap of the window plate 31 by means of a signal from the gap sensor 54 was set so that the gap between the surface of the window plate 31 on the side of the object of polishing and the polished surface of the silicon wafer was constantly controlled to 0.2 mm.

Subsequently, 150 six-inch silicon wafers on which a thermal oxidation film was formed to a thickness of 1 $\mu$m were consecutively polished one wafer at a time under the conditions shown below, and the residual film thickness on the silicon wafers was measured in situ by means of the polished-state measuring device 23.

Polishing head rpm: 50 rpm
Platen rpm: 50 rpm
Load applied to polishing head: $2.4 \times 10^4$ Pa
Oscillation of polishing head: none
Polishing time: 90 sec
Polishing agent used: SS25 manufactured by Cabot Co., diluted 2X with ion exchange water
Polishing agent flow rate: 200 ml/min After the completion of polishing, dressing was performed for 1 minute using a diamond grinding wheel with an abrasive grain size of #100.

As a result, it was found from measurements of the thickness of the polishing body before and after polishing that the polishing body 21 showed 0.17 mm of wear as a result of polishing and dressing. However, there was no scratching of the window plate 31.

Figure 19:
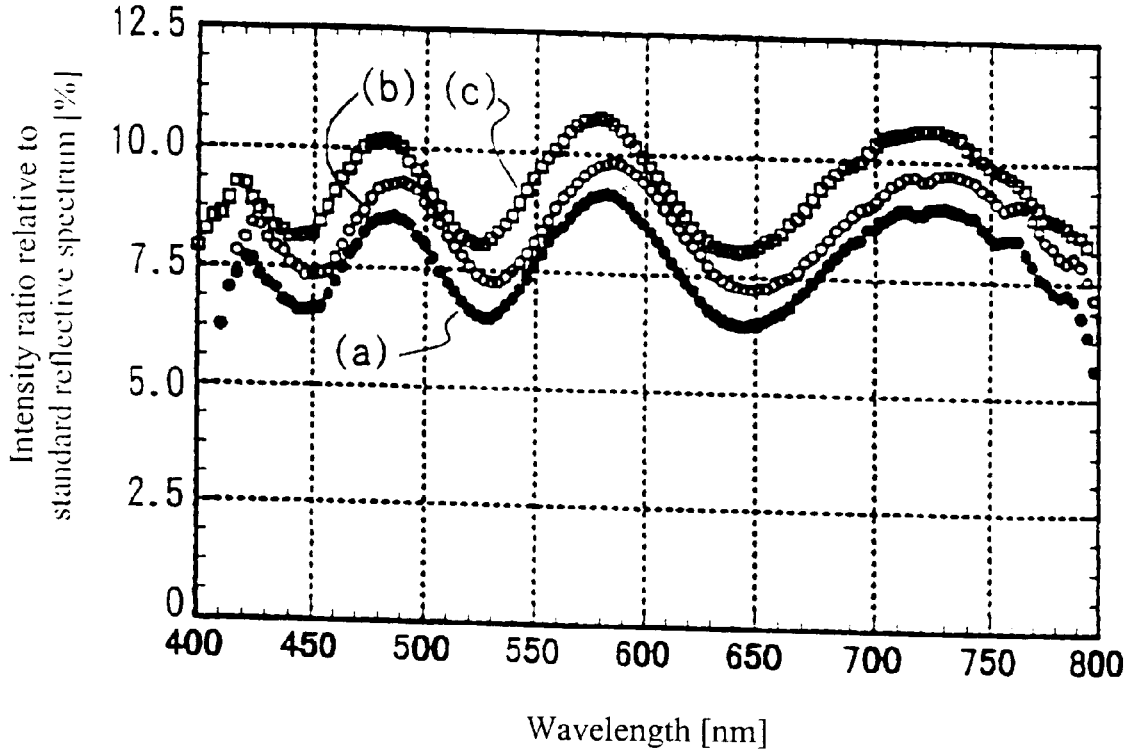
FIG. 19 shows reflective spectra from the silicon wafer surface measured in situ at certain instants during polishing.

FIG. 19 is a graph of the reflective spectra from the surfaces of the silicon wafers that were measured in situ at a certain instant during polishing. In the graph shown in FIG. 19, the horizontal axis indicates wavelength, while the vertical axis indicates the intensity ratio of the measured reflective spectrum to a standard reflective spectrum obtained in a case where a silicon wafer on which an aluminum film had been formed was installed on top of the window part of the polishing body in a state in which ion exchange water was interposed instead of the polishing agent, with the reflective spectrum of the light returning to the polished-state measuring device 23 being taken as the standard reflective spectrum. In the polishing of all of the 150 silicon wafers, reflective spectra such as that indicated by curve(*a*) in FIG. 19 were obtained at a certain instant at which the same time had elapsed from the initiation of polishing; thus, favorable in-situ measurement was accomplished.

Embodiment 1-8

Using the same apparatus as in Embodiment 1-7 (FIG. 17), polishing was performed using the method of Example 2-4. Control was performed so that the gap between the surface of the window on the side of the object of polishing and the polished surface of the object of polishing was 0.1 mm when the window plate 31 was positioned beneath the silicon wafer, and so that the gap between the surface of the window on the side of the object of polishing and the polished surface of the object of polishing was 0.5 mm when the window plate 31 was positioned in other positions.

Subsequently, 150 six-inch silicon wafers on which a thermal oxidation film was formed to a thickness of 1 $\mu$m were consecutively polished one wafer at a time under the conditions shown below, and the residual film thickness on the silicon wafers was measured in situ by means of the polished-state measuring device 23.

Polishing head rpm: 50 rpm
Platen rpm: 50 rpm
Load applied to polishing head: $2.4 \times 10^4$ Pa
Oscillation of polishing head: none
Polishing time: 90 sec
Polishing agent used: SS25 manufactured by Cabot Co., diluted 2X with ion exchange water
Polishing agent flow rate: 200 ml/min
Dressing conditions: 1 minute for each silicon wafer polished, using a diamond grinding wheel with an abrasive grain size of #100

As a result, it was found from measurements of the thickness of the polishing body before and after polishing that the polishing body 21 showed 0.15 mm of wear as a result of polishing and dressing. However, there was no scratching of the window plate 31. Furthermore, in the polishing of all of the 150 silicon wafers, reflective spectra such as that indicated by curve (*b*) in FIG. 19 were obtained at a certain instant at which the same time had elapsed from the initiation of polishing; thus, favorable in-situ measurement was accomplished.

Embodiment 1-9

A polishing apparatus with a construction of the type shown in FIG. 18 was manufactured. A transparent rubber window 59 with a thickness of 0.2 mm was attached to the upper end of the window fastening tube 58, and a glass window 60 was attached to the lower end.

A polishing body 21 (IC1000 /SUBA400 manufactured by Rodel Co.) in which an opening part conforming to the size of the transparent rubber window 59 was formed was bonded to the platen 20; then, the window fastening tube 58 was installed in the opening part 22 of the platen 20 so that the gap from the surface of the transparent rubber window 59 on the side of the object of polishing to the surface of the polishing body 21 under reduced pressure (ordinary pressure) was 0.6 mm.

The apparatus was set so that the pressure inside the window fastening tube 58 was increased when a silicon wafer 17 was present above the opening part 22, thus causing the surface of the transparent rubber window 59 on the side of the object of polishing to adhere tightly to the polished surface of the silicon wafer 17.

Subsequently, 150 six-inch silicon wafers on which a thermal oxidation film was formed to a thickness of 1 $\mu$m were consecutively polished one wafer at a time under the conditions shown below, and the residual film thickness on the silicon wafers was measured in situ by means of the polished-state measuring device 23.

| |
|---|
| Polishing head rpm: 50 rpm |
| Platen rpm: 50 rpm |
| Load applied to polishing head: $2.4 \times 10^4$ Pa |
| Oscillation of polishing head: none |
| Polishing time: 90 sec |
| Polishing agent used: SS25 manufactured by Cabot Co., diluted 2X with ion exchange water |
| Polishing agent flow rate: 200 ml/min |
| Dressing conditions: 1 minute for each silicon wafer polished, using a diamond grinding wheel with an abrasive grain size of #100 |

As a result, it was found from measurements of the thickness of the polishing body before and after polishing that the polishing body showed 0.16 mm of wear as a result of polishing and dressing. However, there was no scratching of the window 31. Furthermore, in the polishing of all of the 150 silicon wafers, reflective spectra such as that indicated by curve(*c*) in FIG. 19 were obtained at a certain instant at which the same time had elapsed from the initiation of polishing; thus, favorable in-situ measurement was accomplished.

Below, an example relating to the invention that is used to achieve the second aspect of the present invention will be described.

Example 2-1

Figure 20:
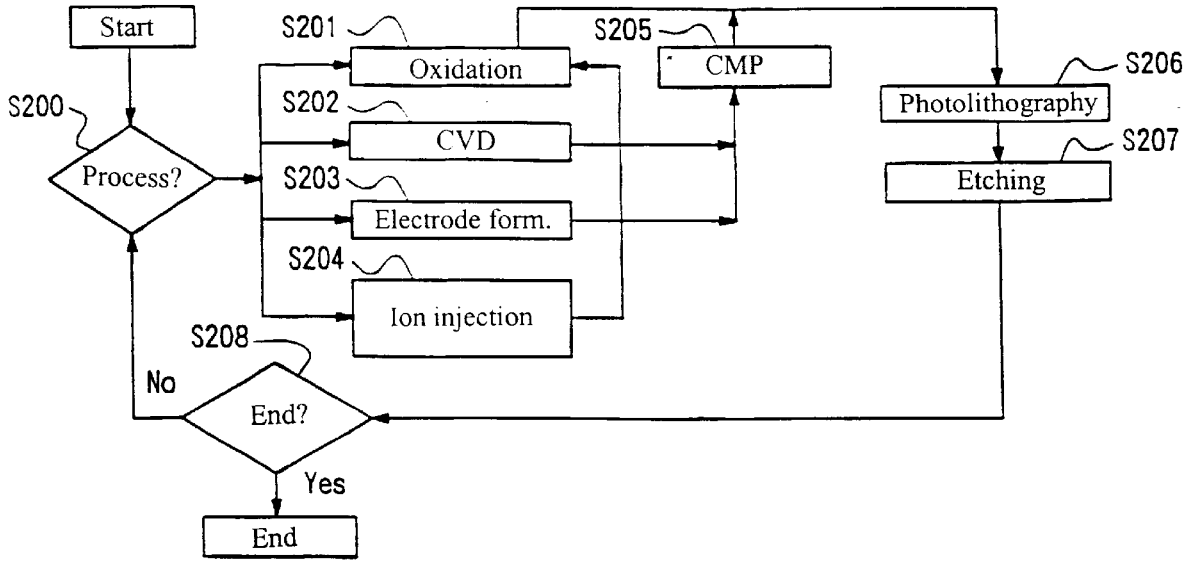
FIG. 20 illustrates the semiconductor device manufacturing process.

FIG. 20 is a flow chart which illustrates the semiconductor device manufacturing process of the present invention. When the semiconductor device manufacturing process is started, an appropriate working process is first selected in step S200 from steps S201 through S204 described below. The processing then proceeds to one of the steps S201 through S204 in accordance with this selection.

Step S201 is an oxidation process in which the surface of the silicon wafer is oxidized. Step S202 is a CVD process in which an insulating film is formed on the surface of the silicon wafer by CVD, etc. Step S203 is an electrode formation process in which electrodes are formed on the silicon wafer by a process such as vacuum evaporation, etc. Step S204 is an ion injection process in which ions are injected into the silicon wafer.

Following the CVD process or electrode formation process, the work proceeds to step S205. Step S205 is a CMP process. In this CMP process, the smoothing of inter-layer insulation films or the formation of a damascene by the polishing of metal films on the surfaces of semiconductor devices, etc., is performed using the polishing apparatus of the present invention.

Following the CMP process or oxidation process, the work proceeds to step S206. Step S206 is a photolithographic process. In this photolithographic process, the silicon wafer is coated with a resist, a circuit pattern is burned onto the silicon wafer by exposure using an exposure apparatus, and the exposed wafer is developed. Furthermore, the next step S207 is an etching process in which the portions other than the developed resist image are removed by etching, and the resist is then stripped away, so that the resist that is unnecessary when etching is completed is removed.

Next, in step S208, a judgement is made as to whether or not all of the necessary processes have been completed; if these processes have not been completed, the work returns to step S200, and the previous steps are repeated so that a circuit pattern is formed on the silicon wafer. If it is judged in step S208 that all of the processes have been completed, the work is ended.

Since the polishing apparatus and polishing method of the present invention are used in the CMP process in the semiconductor device manufacturing method of the present invention, the precision of polishing endpoint detection or the precision of film thickness measurement in the CMP process can be improved, so that the yield of the CMP process is improved. As a result, semiconductor devices can be manufactured at a lower cost than in conventional semiconductor device manufacturing methods.

Furthermore, the polishing apparatus of the present invention can also be used in the CMP processes of semiconductor device manufacturing processes other than the above-mentioned semiconductor device manufacturing process.

As was described above, the present invention can be used as the apparatus and method employed in the CMP process of a semiconductor manufacturing process. As a result, the precision of polishing endpoint detection or the precision of film thickness measurement in the CMP process can be improved, so that the yield of the CMP process is improved. Accordingly, semiconductor devices can be manufactured at a lower cost than in conventional semiconductor device manufacturing methods.

Figure 1A:
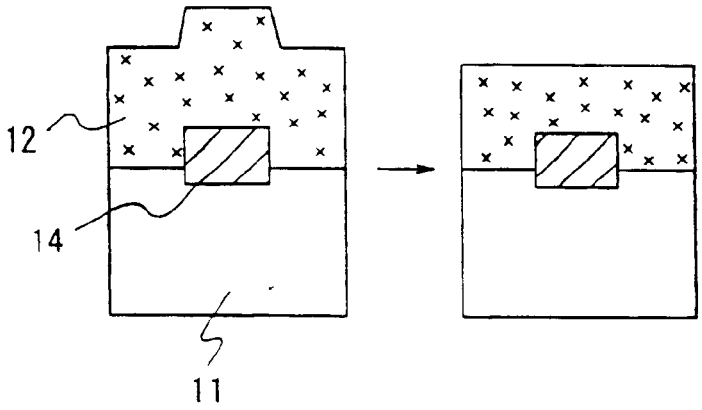
FIGS. 1A and 1B show an example of a planarization technique used in a semiconductor process; the left side of the figures shows the state prior to planarization, while the right side of the figures shows the state following planarization.
Figure 1B:
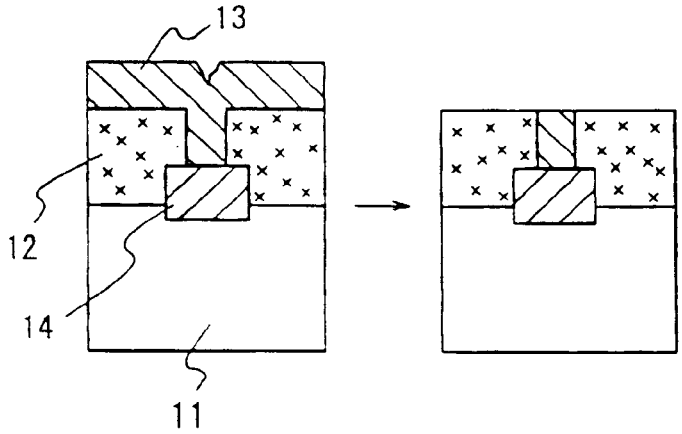

Furthermore, in the description of the present invention, the polishing of wafers on which a pattern was formed as shown in FIG. 1 was described as an example; however, it goes without saying that the present invention can also be used for other purposes such as polishing for the purpose of smoothing bare silicon wafers, etc.

What is claimed is:

1. A polishing body used in a polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body comprises:

at least one opening part, which allows passage of measurement light that optically measures a surface that is being polished on the object of polishing, formed in the polishing body;

at least one window plate, that is transparent to at least the measurement light, positioned in the at least one opening part; and a gap between an outermost surface of the polishing body and a surface of the at least one window plate on a side of the outermost surface in an unloaded state is adjusted so that the gap is greater than an amount of compressive deformation of the polishing body that occurs when a polishing load is applied, wherein a minimum value G of the gap between the outermost surface of the polishing body and the surfaces of the at least one window plate on the side of the outermost surface is such that $10\ \mu m < G \leqq 200\ \mu m$.

2. A polishing body used in a polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body comprises:

at least one opening part, which allows passage of measurement light that optically measures a surface that is being polished on the object of polishing, formed in the polishing body;

at least one window plate, that is transparent to at least the measurement light, positioned in the at least one opening part; and a gap between an outermost surface of the polishing body and a surface of the at least one window plate on a side of the outermost surface in an unloaded state is adjusted so that the gap is greater than an amount of compressive deformation of the polishing body that occurs when a polishing load is applied, wherein the gap G between the outermost surface of the polishing body and the surfaces of the at least one window plate on the side of the outermost surface is a maximum value of G in cases where the gap G differs within one of a single opening part and between different opening parts is such that $0\ \mu m < G \leqq 90\%$ of a thickness of the polishing body, and a thickness t of the window plate is a minimum value of the thickness t in cases where this thickness t differs within one of a single opening part and between different opening parts is such that $t \geqq 10\%$ of a thickness of the polishing body.

3. A polishing body used in a polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body comprises:

at least one opening part, which allows passage of measurement light that optically measures a surface that is being polished on the object of polishing, formed in the polishing body;

at least one window plate, that is transparent to at least the measurement light, positioned in the at least one opening part; and a gap between an outermost surface of the polishing body and a surface of the at least one window plate on a side of the outermost surface in an unloaded state is adjusted so that the gap is greater than an amount of compressive deformation of the polishing body that occurs when a polishing load is applied, wherein at least a surface of the at least one window plate located on a side of the object of polishing is coated with a hard coating.

4. A polishing body used in a polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body comprises:

at least one opening part, which allows passage of measurement light that optically measures a surface that is being polished on the object of polishing, formed in the polishing body;

at least one window plate, that is transparent to at least the measurement light, positioned in the at least one opening part, wherein the window plate comprises at least two plates comprising transparent materials; and a gap between an outermost surface of the polishing body and a surface of the at least one window plate on a side of the outermost surface.

5. The polishing body of claim 4, wherein the at least one window plate comprises two plates of transparent materials that are laminated together, and among these plates of transparent materials, a compressive elastic modulus of the transparent material plate that is located on a side of the object of polishing is set at a value lower than a compressive elastic modulus of the transparent material plate that is located on an opposite side from the object of polishing.

6. The polishing body of claim 5, wherein the compressive elastic modulus e of the transparent material on the side of the object of polishing is such that $2.9\times10^7\ Pa \leqq e \leqq 1.47\times10^9\ Pa$, and the compressive elastic modulus of the transparent material is substantially equal to the compressive elastic modulus of the polishing body.

7. The polishing body of claim 4, wherein a compressive elastic modulus e of the transparent material on a side of the object of polishing is such that $2.9\times10^7\ Pa \leqq e \leqq 1.47\times10^9\ Pa$, and the compressive elastic modulus of the transparent material is substantially equal to the compressive elastic modulus of the polishing body.

8. The polishing body of claim 4, wherein a transmissivity of the at least one window plate with respect to the measurement light is 22% or greater.

9. A polishing body used in a polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body comprises:

at least one opening part, which is used to allow passage of measurement light that optically measures a surface that is being polished on the object of polishing, formed in the polishing body;

at least one window plate, that is transparent to the measurement light, positioned in the at least one opening part, wherein a surface of the at least one window plate on a side of the object of polishing is recessed with respect to a surface of the polishing body, with an amount of the recess being varied in one of a stepwise manner and a continuous manner; and a gap between an outermost surface of the polishing body and the surface of the at least one window plate on a side of the outermost surface.

10. The polishing body of claim 9, wherein the polishing body has a plurality of the at least one opening part, and the amount of recess varies in a stepwise manner as a result of the amount of recess being different in each of the plurality of the at least one opening part.

11. The polishing body of claim 9, wherein the amount of recess varies in a stepwise manner as a result of the amount of recess being different in at least two portions within a same opening part.

12. The polishing body of claim 9, wherein the at least one window plate is a parallel flat-plate-form transparent plate, and the at least one window plate is inclined with respect to the surface of the polishing body, such that the amount of recess varies in a continuous manner.

13. The polishing body of claim 9, wherein at least a surface of the at least one window plate located on a side of the object of polishing is coated with a hard coating.

14. The polishing body of claim 9, wherein a transmissivity of the at least one window plate with respect to the measurement light is 22% or greater.

15. A polishing body used in a polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body comprises:

at least one opening part, which is used to allow passage of measurement light that optically measures a surface that is being polished on the object of polishing, formed in the polishing body; and at least one window plate, that is transparent to the measurement light, positioned in the at least one opening part, wherein a surface of the at least one window plate on a side of the object of polishing is recessed with respect to a surface of the polishing body, and the at least one window plate is constructed from a plate material comprising a plurality of sheets of a transparent material that can be stripped away.

16. The polishing body of claim 15, wherein a transmissivity of the at least one window plate with respect to the measurement light is 22% or greater.

17. A polishing apparatus comprising:

a polishing head that holds an object of polishing, wherein the polishing apparatus polishes the object of polishing by causing relative motion between the polishing body and the object of polishing in a state in which a polishing agent is interposed between the polishing body and the object of polishing, wherein the polishing body is the polishing body of any one of claims 3, 4, 4, 7 and 12.

18. The polishing apparatus of claim 17, wherein the measurement light is projected onto the object of polishing from a light-projecting device via the at least one window plate and the at least one opening part, wherein the projected light is reflected by the object of polishing, and the reflected light passing through the at least one opening part and the at least one window plate is received by a light-receiving device, an intensity of the reflected light that is received during polishing in at least 1% of an intensity of the projected light.

19. The polishing apparatus of claim 17, wherein the at least one window plate comprises a resin having polishing characteristics comparable to polishing characteristics of the polishing body.

20. A method to adjust a gap between an outermost surface of a polishing body and a surface of at least one window plate on a side of the outermost surface in the polishing apparatus of claim 17, wherein the measurement light is directed onto the object of polishing from a light-projecting device via the at least one window plate and the at least one opening part and is reflected by the object of polishing, and the reflected light passing through the at least one opening part and the at least one window plate is received by a light-receiving device; wherein the polishing apparatus adjustment method comprises:

a stage in which the gap between the outermost surface of the polishing body and the surfaces of the at least one window plate on the side of the outermost surface is adjusted on a basis of a signal measured by the light-receiving device.

21. A method for measuring one of a thickness of a polished film and an endpoint of polishing in which polishing is performed using the polishing apparatus of claim 17, and one of the thickness of the polished film and the endpoint of polishing is measured using a light signal received by a light-receiving device; wherein a signal measured by a measurement means used to measure one of the polished film thickness and the polishing endpoint is not used in the measurement of one of the polished film thickness and the polishing endpoint in cases where the signal measured by the measurement means is equal to a signal that is measured beforehand and stored in memory.

22. A polishing apparatus comprising:

a polishing head that holds an object of polishing;

a polishing body positioned on a platen, wherein the polishing apparatus polishes the object of polishing by causing relative motion between the polishing body and the object of polishing in a state in which a polishing agent is interposed between the polishing body and the object of polishing; wherein the polishing apparatus comprises:

at least one first opening part formed in the platen;

at least one second opening part formed in the polishing body;

a plurality of windows disposed to block at least portions of the at least one second opening part formed in the polishing body;

a device which measures a polished state by optically observing a polished surface of the object of polishing via the plurality of windows; and a moving device which moves positions of the plurality of windows on the surface of the object of polishing, wherein the at least one second opening part formed in the polishing body and the at least one first opening part formed in the platen are superimposed, so that the plurality of windows are disposed on the platen via the moving device.

23. The polishing apparatus of claim 22, further comprising:

a device that senses a gap between surfaces of the plurality of windows on a side of the object of polishing and a polished surface of the object of polishing;

one of a device that senses conditions of wear of the polishing body, and a device that senses the gap and conditions of wear.

24. The polishing apparatus of claim 23, further comprising:

a control device that controls the gap between the surfaces of the plurality of windows on the side of the object of polishing and the polished surface of the object of polishing.

25. The polishing apparatus of claim 24, further comprising:

a function which predicts an amount of wear of the polishing body from polishing conditions, polishing time, dressing conditions and dressing time, and controls the gap between the surfaces of the plurality of windows on the side of the object of polishing and the polished surface of the object of polishing.

26. The polishing apparatus of claim 24, further comprising:

a function which controls the moving device so that the gap between the surfaces of the plurality of windows on the side of the object of polishing and the polished surface of the object of polishing is maintained at a constant value.

27. The polishing apparatus of claim 24, further comprising:

a function which controls the gap between the surfaces of the plurality of windows on the side of the object of polishing and the polished surface of the object of polishing in synchronization with rotation of the platen.

28. A semiconductor device manufacturing method which includes use of the apparatus of claim 17 in a manufacturing process.

29. A semiconductor device manufacturing method which includes use of the apparatus of claim 22 in a manufacturing process.

30. A semiconductor device manufacturing method which includes use of the method of claim 20 in a manufacturing process.

31. A semiconductor device manufacturing method which includes use of the method of claim 21 in a manufacturing process.

* * * * *